US009782659B2

(12) United States Patent
Yamazaki

(10) Patent No.: US 9,782,659 B2
(45) Date of Patent: Oct. 10, 2017

(54) WALKING TRAINING SYSTEM

(71) Applicant: TOYOTA JIDOSHA KABUSHIKI KAISHA, Toyota-shi, Aichi-ken (JP)

(72) Inventor: Seisuke Yamazaki, Toyota (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 3 days.

(21) Appl. No.: 14/961,311

(22) Filed: Dec. 7, 2015

(65) Prior Publication Data

US 2016/0158622 A1 Jun. 9, 2016

(30) Foreign Application Priority Data

Dec. 9, 2014 (JP) ..... 2014-249341

(51) Int. Cl.

| | |
|---|---|
| ***A63B 24/00*** | (2006.01) |
| ***A63B 71/00*** | (2006.01) |
| ***A63B 22/02*** | (2006.01) |
| ***A63B 21/28*** | (2006.01) |
| ***A63B 23/04*** | (2006.01) |
| ***A63B 69/00*** | (2006.01) |
| *A63B 22/00* | (2006.01) |

(52) U.S. Cl.

CPC ..... *A63B 71/0054* (2013.01); *A63B 21/285* (2013.01); *A63B 22/02* (2013.01); *A63B 23/04* (2013.01); *A63B 24/0062* (2013.01); *A63B 24/0087* (2013.01); *A63B 69/0064* (2013.01); *A63B 71/0009* (2013.01); *A63B 2022/0092* (2013.01); *A63B 2022/0094* (2013.01); *A63B 2071/0081* (2013.01); *A63B 2220/52* (2013.01); *A63B 2220/805* (2013.01); *A63B 2220/806* (2013.01); *A63B 2220/807* (2013.01)

(58) Field of Classification Search

CPC ..... A63B 2220/52; A63B 2220/805; A63B 2220/806; A63B 2220/807; A63B 71/0054; A63B 71/0009; A63B 24/0062; A63B 24/0087; A63B 22/02; A63B 2022/0092; A63B 2022/0094; A63B 69/0064

USPC ..... 482/51, 54; 119/700

See application file for complete search history.

(56) References Cited

U.S. PATENT DOCUMENTS

| | | | | |
|---|---|---|---|---|
| 5,100,127 A * | 3/1992 | Melnick | ..... | A01K 15/027 119/700 |
| 6,231,527 B1 | 5/2001 | Sol | | |
| 6,796,927 B2 * | 9/2004 | Toyama | ..... | A63B 22/0242 482/1 |

(Continued)

FOREIGN PATENT DOCUMENTS

| | | |
|---|---|---|
| JP | H09-313638 A | 12/1997 |
| JP | 2011-050451 A | 3/2011 |

(Continued)

*Primary Examiner* — Glenn Richman
(74) *Attorney, Agent, or Firm* — Oliff PLC

(57) ABSTRACT

A walking training system according to the present invention includes a belt conveyor on which a trainee walks, a frame, a sensor, and a control device. The frame, positioned on both sides of the belt conveyor, allows an assistant to place each of the feet thereon. The sensor measures the presence state of a foot on the frame. The control device determines whether there are three or more feet on the frame based on the measurement result of the sensor and, if it is determined that there are three or more feet, performs abnormal-time control.

10 Claims, 24 Drawing Sheets

(56) References Cited

U.S. PATENT DOCUMENTS

| | | | | |
|---|---|---|---|---|
| 7,654,229 | B2 * | 2/2010 | Smith | A01K 11/001 119/14.04 |
| 2003/0078138 | A1 * | 4/2003 | Toyama | A63B 22/0242 482/8 |
| 2004/0018915 | A1 | 1/2004 | Reyes et al. | |
| 2009/0176629 | A1 | 7/2009 | Yi | |
| 2012/0024237 | A1 * | 2/2012 | Rice | A01K 15/027 119/703 |
| 2012/0238921 | A1 | 9/2012 | Kuehne et al. | |
| 2014/0066263 | A1 | 3/2014 | Huang et al. | |
| 2016/0166870 | A1 * | 6/2016 | Lagree | A63B 22/0023 482/142 |

FOREIGN PATENT DOCUMENTS

| | | | |
|---|---|---|---|
| JP | 2013-226340 | A | 11/2013 |
| WO | 93/06779 | A1 | 4/1993 |
| WO | 2014/153201 | A1 | 9/2014 |

* cited by examiner

WALKING TRAINING SYSTEM

INCORPORATION BY REFERENCE

The disclosure of Japanese Patent Application No. 2014-249341 filed on Dec. 9, 2014 including the specification, drawings and abstract is incorporated herein by reference in its entirety.

BACKGROUND OF THE INVENTION

1. Field of the Invention

The present invention relates to a walking training system, and more particularly to a walking training system that has a conveyor on which a trainee walks and a pair of frames on which an assistant places the feet, one on each frame.

2. Description of Related Art

Japanese Patent Application Publication No. 2011-50451 (JP 2011-50451 A) discloses a technology that can measure walking data on the walking state during user's walking training without the user having to wear a special measurement apparatus. The walking rehabilitation device disclosed in Japanese Patent Application Publication No. 2011-50451 (JP 2011-50451 A) includes a pair of right and left belts on which the user places the feet. This walking rehabilitation device further includes a detection unit and a walking data measurement unit. The detection unit detects the electric current value, which flows in the motor for operating each of the pair of right and left belts, at a predetermined time interval. The walking data measurement unit checks the electric current value, detected by the detection unit, to determine whether the user is in the stance foot state or the swing foot state, and displays the determination result on the monitor in the form of a graph.

However, the walking rehabilitation device disclosed in Japanese Patent Application Publication No. 2011-50451 (JP 2011-50451 A) has the problem that the device cannot detect the state in which a trainee cannot walk well and walks off the belt. That is, the problem with the walking rehabilitation device disclosed in Japanese Patent Application Publication No. 2011-50451 (JP 2011-50451 A) is that the device cannot detect an abnormal state that may be generated during walking training.

SUMMARY OF THE INVENTION

It is an object of the present invention to provide a walking training system that can detect an abnormal state during walking training.

According to a first aspect of the present invention, a walking training system includes a belt conveyor on which a trainee walks, a pair of frames, a sensor, and a control device. The pair of the frames is positioned on both sides of the belt conveyor, one frame on each side. An assistant can place each of both feet on the frames. The sensor is configured to measure the presence state of a foot on the frame. The control device is configured to determine whether there are three or more feet on the frame based on the measurement result of the sensor. The control device is configured to perform abnormal-time control if it is determined that there are three or more feet.

According to this configuration, the situation, in which the trainee loses balance during walking and gets out of the conveyor, can be detected. That is, an abnormal state during walking training can be detected.

In the above aspect, the sensor may measure a load from a foot onto the frame. The control device may be configured to determine that there is a foot on the frame when the sensor measures the load.

According to this configuration, a stain-resistant, low-cost system can be implemented as compared to the case in which the determination is made based on an optical measurement result.

In the above aspect, the sensor may measure a load distribution from the foot onto the frame. The control device may be configured to determine that there are two feet if a length between two load distributions is longer than a predetermined length. The control device may be configured to determine that there is one foot if the length between two load distributions is equal to or shorter than the predetermined length.

According to this configuration, when two load distributions are detected for one foot of the assistant, a situation can be prevented in which the two load distributions are incorrectly determined as two load distributions, one for a load distribution of the foot of the trainee and the other for a load distribution of the foot of the assistant.

In the above aspect, the sensor may include a plurality of load sensors each of which measures the load distribution from the foot onto the frame. The plurality of load sensors may be arranged close together on the frame within a predetermined range on a side in the direction opposite to the direction of movement of the trainee.

According to this configuration, the number of load sensors 201 can be reduced and therefore the cost can be reduced.

In the above aspect, the sensor may include an ON/OFF sensor. The ON/OFF sensor is turned on when a foot is placed, and is turned off when a foot is not placed, in a part outside the range in which the plurality of load sensors are arranged on the frame. The control device may be configured to determine that there are three or more feet on the frame when it is determined that there are two feet on the frame based on a measurement result of the plurality of load sensors and if the ON/OFF sensor is turned on.

According to this configuration, an inexpensive ON/OFF sensor can be used to reduce the cost.

In the above aspect, the sensor may include a plurality of photo-electronic sensors. The photo-electronic sensors may observe a boundary between the belt conveyor and the frame. The control device may be configured to determine that there is a foot on the frame if a blocking of light is detected by the photo-electronic sensors.

According to this configuration, an abnormal state during walking training can be detected by a sensor other than a load sensor.

In the above aspect, the control device may be configured to determine that there are two feet when a length of a blocked light is longer than a predetermined length. The control device may be configured to determine that there is one foot when the length of the blocked light is equal to or shorter than the predetermined length.

According to this configuration, a situation can be prevented in which the blocking of light by the foot of the trainee and by the foot of the assistant is incorrectly determined as the blocking of light by one foot of the assistant.

In the above aspect, the sensor may include at least one camera that captures the frame. The control device may be configured to determine that there is a foot on the frame when a foot is recognized by analyzing an image generated by the capturing by the camera.

According to this configuration, an abnormal state during walking training can be detected by a sensor other than a load sensor.

In the above aspect, the control device may decelerate the belt conveyor as the abnormal-time control. In addition, the control device may stop the belt conveyor.

According to this configuration, the trainee can easily recover balance.

According to another aspect, a walking training system includes a belt conveyor on which a trainee walks, a pair of frames, a sensor, and a control device. The pair of frames is positioned on both sides of the belt conveyor, one frame on each side. An assistant can place each of both feet on the frames. The sensor is configured to measure a presence state of a foot on the belt conveyor. The control device may be configured to determine whether there are three or more feet on the belt conveyor based on a measurement result of the sensor. The control device performs abnormal-time control when the control device determines that there are three or more feet.

According to the aspects of the present invention described above, an abnormal state during walking training can be detected.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

Preferred embodiments of the present invention are described below with reference to the drawings. The specific numeric values shown in the embodiments below are only exemplary in order to facilitate the understanding of the present invention and, unless otherwise stated, the values are not limited to those values. In addition, for brevity of the description, the matters obvious to those skilled in the art are omitted or simplified, as necessary, in the description and drawings below.

Figure 1:
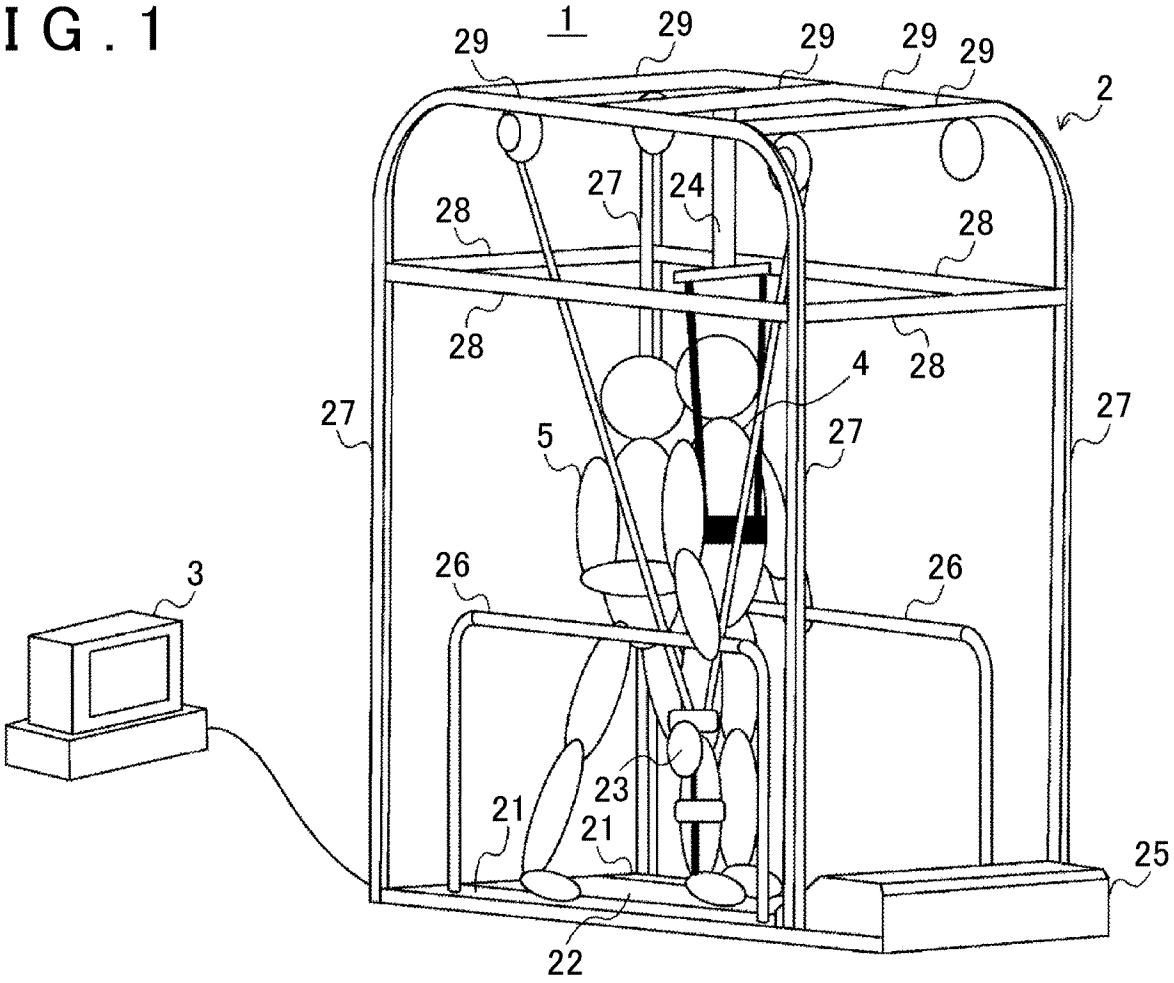
FIG. 1 is a diagram showing a configuration of a walking training system in a first embodiment.

<First embodiment of the present invention>A first embodiment is described. First, the configuration of a walking training system 1 in the first embodiment is described below with reference to FIG. 1. As shown in FIG. 1, the walking training system 1 includes a treadmill 2 and a control device 3.

The treadmill 2 is a device on which a trainee 4 conducts walking training. The treadmill 2 functions as a walking training device. The control device 3 is a device that controls the treadmill 2. The control device 3 is typically a Personal Computer (PC). However, the control device 3 is not limited to a personal computer, but other information processing devices, such as a tablet terminal or a smartphone, may also be used.

The treadmill 2 includes a frame 21, a belt conveyor 22, a robot 23, a relief device 24, a motor box 25, a pair of handrails 26, a plurality of vertical frame components 27, and a plurality of upper frame components 28 and 29.

The frame 21 is a part on which an assistant 5, who assists the trainee 4 to conduct walking training, places each of his or her feet. The frames 21 functions as a footrest on which the assistant 5 places each of the feet. The frame 21 has at least a pair of parts (right frame part and left frame part that will be described later) arranged on both sides of the belt conveyor 22, one on each side. This structure allows the assistant 5 to hold and support the trainee 4, who walks in front of the assistant 5, with both hands while standing on the frame 21 in such a way that the assistant 5 straddles the belt conveyor 22. In this embodiment, the direction in which the trainee 4 walks is called "forward" and the direction opposite to it is called "backward". Therefore, in FIG. 1, the right direction is "forward", and the left direction is "backward".

The belt conveyor 22 is a part on which the trainee 4 walks. The belt conveyor 22 functions as a walking part on which the trainee 4 walks. The belt conveyor 22 has its belt rotated in such a way that the trainee 4 is moved in the backward direction under control of the control device 3. In other words, the top surface of the belt conveyor 22 moves in the backward direction. This allows the trainee 4 to continue walking at a predetermined position.

The robot 23 is a robot suit that assists the trainee 4 to walk. The robot 23 is attached to the affected leg of the trainee 4. The robot 23 assists the trainee 4 in the action of the affected leg under control of the control device 3. For example, the robot 23 operates to flex the knee joint of the trainee 4 at a predetermined time interval to implement the action of the affected leg while the trainee 4 walks.

The relief device 24 supports the trainee 4 by hanging the trainee 4. The relief device 24 has its one end fixed on the upper frame component 29. The other end of the relief device 24 is in the shape of a belt that is attached to the upper body of the trainee 4. This allows the trainee 4 to maintain the standing posture even when the trainee 4 loses balance during walking training.

The motor box 25 has a rotation axis (not shown) of the belt conveyor 22 and a motor (not shown) that rotates the rotation axis. The motor in the motor box 25, when driven under control of the control device 3, causes the belt conveyor 22 to move.

The handrail 26 is provided on the right and left of the belt conveyor 22. The handrail 26 has an inverted U-shape shape and has its two ends coupled onto the top face of the frame 21. This allows the trainee 4 to hold the right and left handrails 26 with the right and left hands to enable him or her to maintain the standing posture easily.

The vertical frame components 27 are components each extending upright. Although FIG. 1 shows an example in which the treadmill 2 has four vertical frame components 27, one in each of the right front position, left front position, right rear position, and left rear position, the positions and the number of vertical frame components 27 are not limited to those shown in the example.

The upper frame components 28, provided in the upper part of the vertical frame components 27, are components that couple the vertical frame components 27 together. FIG. 1 shows an example in which the treadmill 2 has four upper frame components 28. More specifically, in the example shown in FIG. 1, the treadmill 2 has the upper frame component 28 that couples the vertical frame components 27 in the right front position and the left front position, the upper frame component 28 that couples the vertical frame components 27 in the right rear position and the left rear position, the upper frame component 28 that couples the vertical frame components 27 in the right front position and the right rear position, and the upper frame component 28 that couples the vertical frame components 27 in the left front position and the left rear position. However, the number of upper frame components 28 and the combinations of the upper frame component 28 and the vertical frame components 27, to which the upper frame component 28 is connected, are not limited to those shown in the figure.

The upper frame components 29, provided in the uppermost position of the vertical frame components 27, are components that couple the vertical frame components 27 together. In other words, the upper frame component 29, provided above the upper frame component 28, is a component that couples the vertical frame components 27. FIG. 1 shows an example in which the treadmill 2 has five upper frame components 29. More specifically, in the example shown in FIG. 1, the treadmill 2 has the upper frame component 29 that couples the vertical frame components 27 in the right front position and the right rear position, the upper frame component 29 that couples the vertical frame components 27 in the left front position and the left rear position, and three upper frame components 29 that couple those upper frame components 29.

As described above, the relief device 24 has one end connected to the upper frame component 29. The robot 23, also connected to the upper frame component 29 via a cable, is supported in such a way that the robot 23 hangs from the upper frame component 29. This reduces the load of the robot 23 that is applied to the trainee 4.

Figure 2:
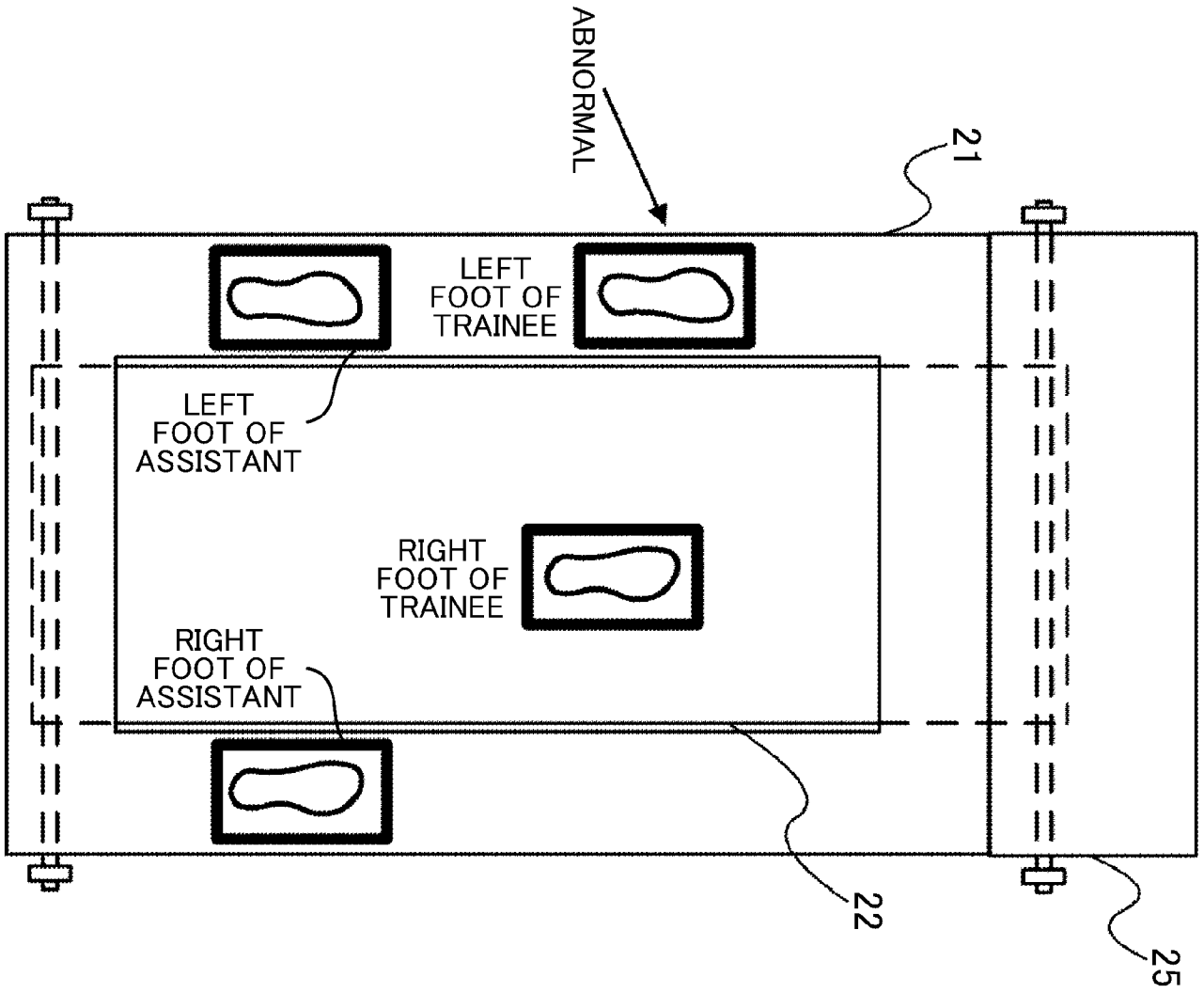
FIG. 2 is a top view showing a frame and a conveyor in the first embodiment.

Next, with reference to FIG. 2, the abnormality detection method of the walking training system 1 in the first embodiment is described below. FIG. 2 is a top view of the frame 21 and the belt conveyor 22.

As described above, the treadmill 2 has the frame 21 and the belt conveyor 22. As shown in FIG. 2, the frame 21 has the shape of the katakana symbol for "ro". The right frame part of the frame 21 is arranged to the right of the belt conveyor 22. The left frame part of the frame 21 is arranged to the left of the belt conveyor 22. Although FIG. 2 shows an example in which the front frame part and the rear part of the frame 21 overlap over the belt conveyor 22, the configuration is not limited to this configuration. The front frame part of the frame 21 may be arranged before the front end of the belt conveyor 22, and the rear frame part of the frame 21 may be arranged after the rear end of the belt conveyor 22. In addition, the frame 21 may be configured to have only the right frame part and the left frame part, but not the front frame part and rear frame part.

In such a configuration, the walking training system 1 determines that an abnormal state is generated if it is determined there are three or more feet on the frame 21. This state is generated, for example, when the trainee 4 loses balance during walking training and one foot of the trainee 4 gets out onto the frame 21 that is outside the belt conveyor 22, as shown in FIG. 2. In this state, it is difficult for the trainee 4 to continue walking training and is necessary for the trainee 4 to once recover balance.

To address this case, if it is determined that an abnormal state is detected, the walking training system 1 performs abnormal-time control. For example, the walking training system 1 performs at least one of the following controls as the abnormal-time control, that is, control to reduce the speed of the belt conveyor 22, to stop the belt conveyor 22, to stop the operation of the robot 23, and to notify a warning to the trainee 4 and the assistant 5.

Now, in the walking training system 1, load sensors are arranged on the frame 21 to detect a load from the foot of the trainee 4 and the assistant 5 onto the top face of the frame 21 as will be described later. If a load is detected on the top face of the frame 21 is detected, the walking training system 1 determines that there is a foot on the frame 21. Therefore, if the load on the frame 21 is detected at three or more points on the frame 21, the walking training system 1 basically determines that there are three or more feet on the frame 21.

However, depending upon how the load from the assistant 5 is applied onto the frame 21, there is a possibility that the load only from the assistant 5 appears to be applied at three or more points on the frame 21. For example, in some cases, the load is not detected below the arch of the foot, but the tiptoe and the heel are detected as separate load points. In this case, if no consideration is given to this condition, an abnormal state may be incorrectly determined due to the load only from the foot of the assistant 5 even if the trainee 4 does not place a foot on the frame 21. To solve this problem, one of the two methods described below is used in the first embodiment to avoid such an incorrect determination.

Figure 3:
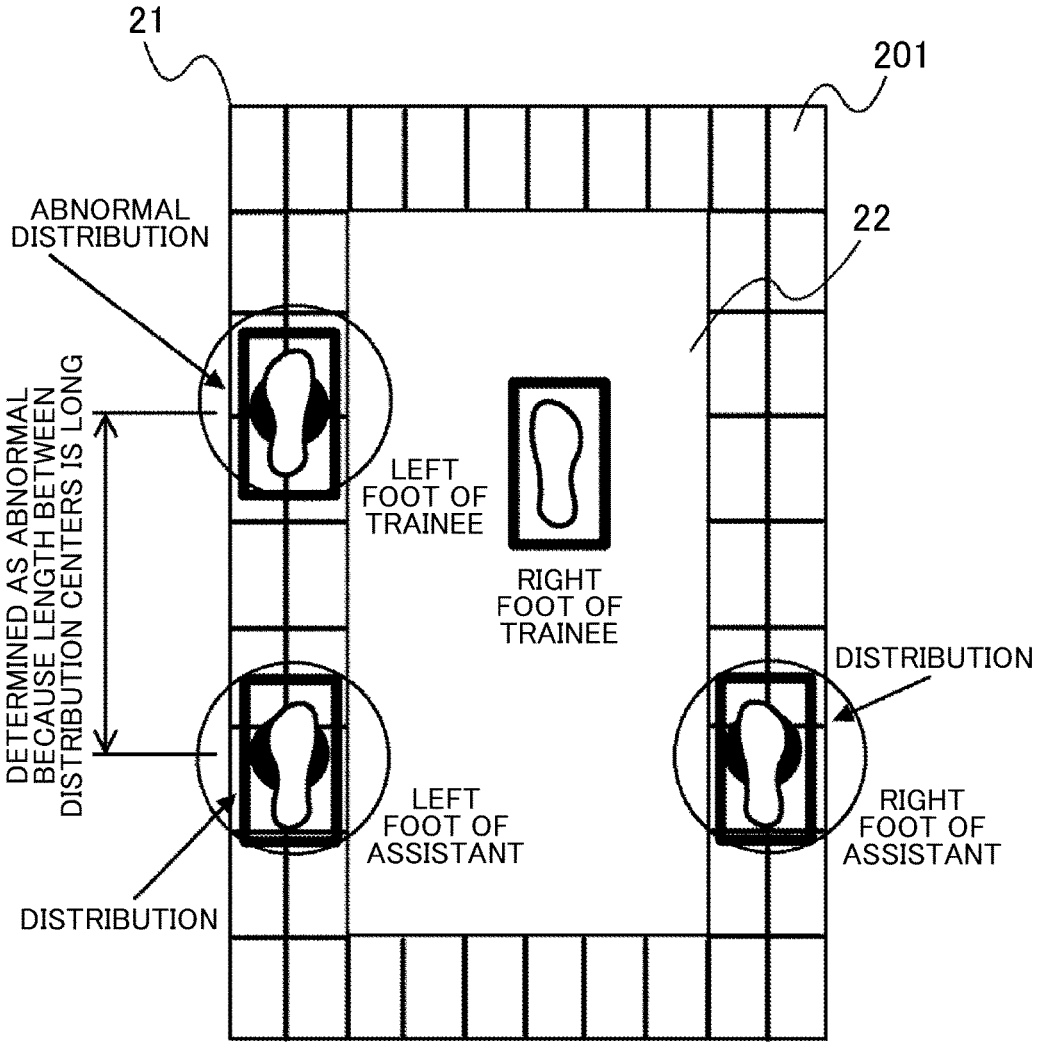
FIG. 3 is a diagram showing a first determination method in the first embodiment.

Next, a first method is described with reference to FIG. 3. As shown in FIG. 3, a plurality of load sensors 201 is arranged on the frame 21 in a grid pattern. That is, rectangular load sensors 201 are arranged closely to each other on the frame 21. FIG. 3 shows an example in which the left foot of the trainee 4 gets out onto the frame 21.

Each of the plurality of load sensors 201 detects a load distribution on the frame 21. If two independent load distributions are detected by the load sensors 201, the control device 3 determines whether the length between the centers of the two load distributions is longer than a predetermined length. If it is determined that the length between the centers of the two load distributions is longer than the predetermined length, the control device 3 regards the two load distributions as separate load-points. That is, the control device 3 determines one of the two load distributions as the load distribution of the foot of the trainee 4, and the other as the load distribution of the foot of the assistant 5, respectively. In other words, the control device 3 determines that there are the foot of the trainee 4 and the foot of the assistant on the frame 21. On the other hand, if it is determined that the length between the centers of the two load distributions is equal to or shorter than the predetermined length, the control device 3 regards the two load distributions as one load point. That is, the control device 3 determines the two load distributions as one load distribution of the foot of the assistant 5. In other words, the control device 3 determines that there is only the foot of the assistant on the frame 21.

Any value may be set as the predetermined length described above as long as the length is long enough for identifying between the load distributions created by the trainee 4 and the assistant 5 and the load distribution created only by the assistant 5. Preferably, the predetermined length is set to the foot size of the assistant 5.

According to the first method described above, it is possible to identify between the case, in which three or more independent loads, created by the trainee 4 and the assistant 5, are detected and therefore it is determined there are three or more feet on the frame 21 as shown in FIG. 3, and the case in which three or more independent loads, created by the assistant 5 only, are detected and therefore it is determined that there are not three or more feet on the frame 21.

Next, a second method is described with reference to FIG. 4. As described above, a plurality of load sensors 201 is arranged on the frame 21 in a grid pattern. Also in FIG. 4, an example in which the left foot of the trainee 4 gets out onto the frame 21 is shown.

If two independent load distributions are detected by the load sensors 201, the control device 3 determines whether the length of the whole of the two load distributions is longer than a predetermined length. The length of the whole of the load distributions is, for example, the longest of the lengths from one end of one load distribution to one end of the other load distribution. If it is determined that the length of the whole of the two load distributions is longer than the predetermined length, the control device 3 regards the two load distributions as separate load-points. On the other hand, if it is determined that the length of the whole of the two load distributions is equal to or shorter than the predetermined length, the control device 3 regards the two load distributions as one load-point. The predetermined length in the second method may be set in the same manner as described in the first method.

Figure 4:
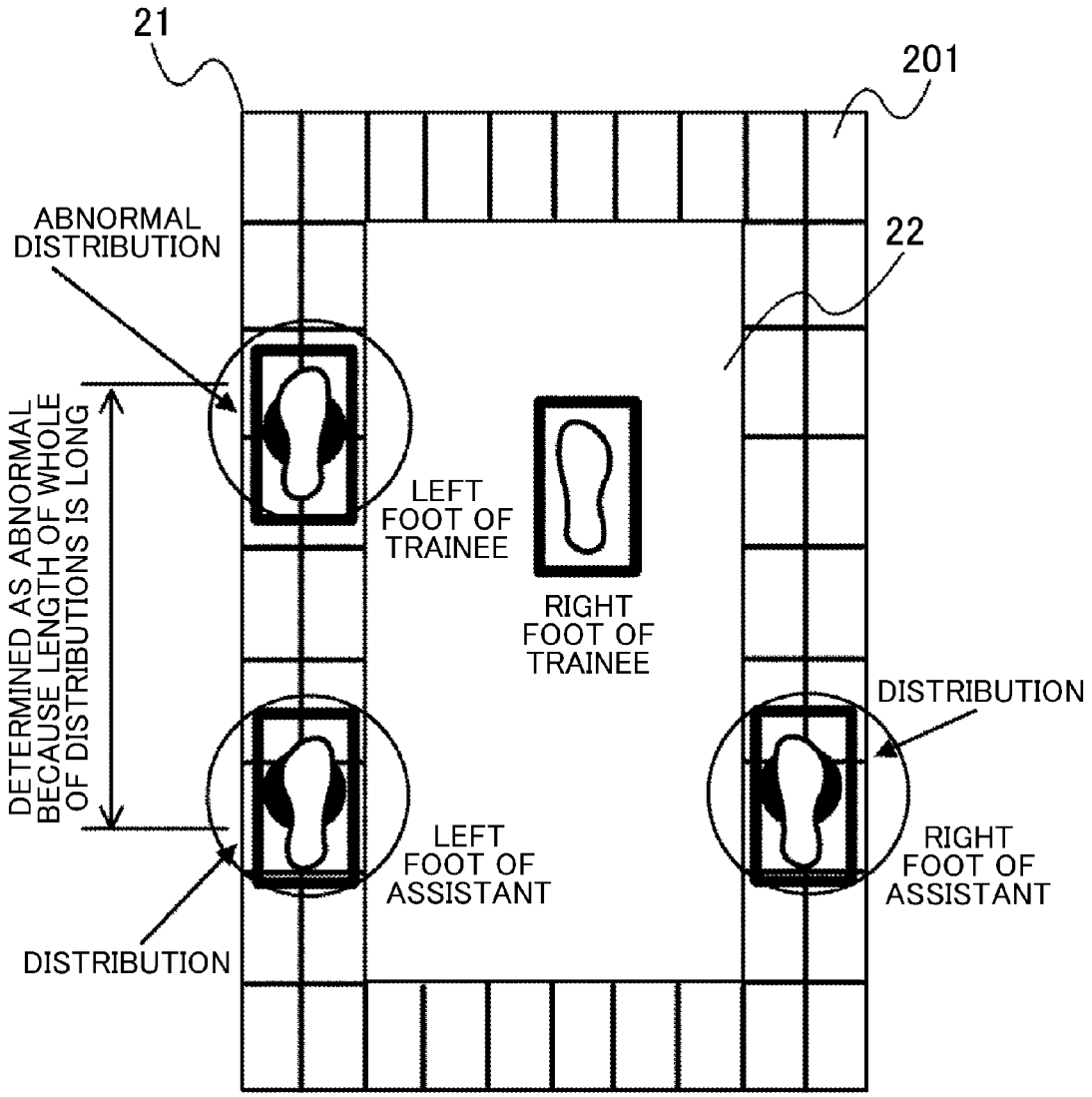
FIG. 4 is a diagram showing a second determination method in the first embodiment.

According to the second method described above, too, it is possible to identify between the case, in which three or more independent loads, created by the trainee 4 and the assistant 5, are detected and therefore is it determined that there are three or more feet on the frame 21 as shown in FIG. 4, and the case in which three or more independent loads, created by the assistant 5 only, are detected and therefore it is determined that there are not three or more feet on the frame 21.

As described above, an incorrect determination can be avoided by determining that there are two feet if the length between the two load distributions is longer than the predetermined length and that there is one foot if the length between the two load distributions is equal to or shorter than the predetermined length. In this case, the length between the two load distributions used in that determination may be the length between the centers of the two load distributions as described in the first method or may be the length of the whole of the two load distributions (length from the end of one load distribution to the end of the other load distribution) as described in the second method. The determination in the first method and the determination in the second method are performed independently in the right frame part and the left frame part of the frame 21.

Figure 5:
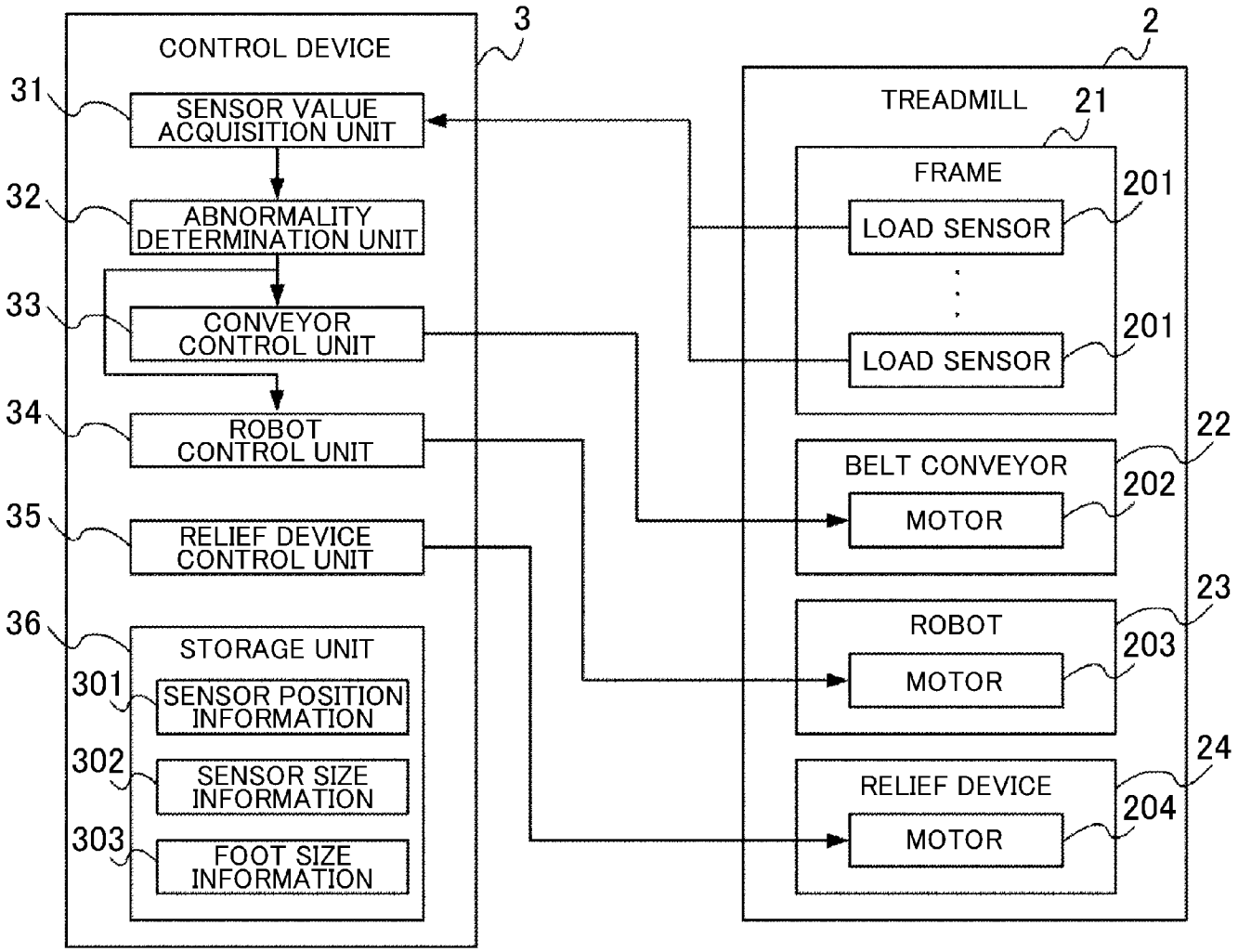
FIG. 5 is a diagram showing a configuration of the control system of the walking training system in the first embodiment.

Next, the configuration of the control system of the walking training system 1 in the first embodiment is described below with reference to FIG. 5. In the treadmill 2, the frame 21 has a plurality of load sensors 201, the belt conveyor 22 has a motor 202, the robot 23 has a motor 203, and the relief device 24 has a motor 204, as shown in FIG. 5.

The plurality of load sensors 201 are arranged on the frame 21 in the grid pattern as described above. Each of the plurality of load sensors 201 detects (measures) a load distribution on the frame 21 and sends the load distribution information, which indicates the detected load distribution, to the control device 3.

The motor 202 is a motor that rotates the belt of the belt conveyor 22 described above. The motor 202 corresponds to the motor in the motor box 25 described above. The motor 202 is driven according to a command value received from the control device 3 to rotate the belt of the belt conveyor 22.

The motor 203 causes the robot 23 to perform the flexion movement. The motor 203, driven according to a command value received from the control device 3, causes the robot 23 to perform the flexion movement. The control device 3 sends a command value to the motor 203 to cause the robot 23 to perform the flexion movement at a predetermined time interval. This causes the robot 23 to flex the knee joint of the trainee at a predetermined time interval to implement the walking-time movement for the affected leg as described above.

The motor 204 pulls the relief device 24 upward. The motor 204, driven according to a command value received from the control device 3, pulls the relief device 24 upward. After the trainee 4 wears the relief device 24, the control device 3 sends a command value to pull the relief device 24 upward. This allows the trainee 4 to assume the standing posture before starting walking training.

As shown in FIG. 5, the control device 3 includes a sensor value acquisition unit 31, an abnormality determination unit 32, a conveyor control unit 33, a robot control unit 34, a relief device control unit 35, and a storage unit 36. The control device 3 includes a central processing unit (CPU) and executes the programs, which execute the processing of the units 31 to 35 described above, via the CPU to implement the functions of the units 31 to 35.

The sensor value acquisition unit 31 receives the load distribution information sent from each of the plurality of load sensors 201. More specifically, the sensor value acquisition unit 31 receives the load distribution information from each of the plurality of load sensors 201 at a predetermined time interval while the trainee 4 conducts walking training.

The abnormality determination unit 32 determines whether there are three or more feet on the frame 21 based on the load distribution information received by the sensor value acquisition unit 31. If it is determined that there are not three or more feet on the frame 21, the abnormality determination unit 32 determines that the state is normal. On the other hand, if it is determined that there are three or more feet on the frame 21, the abnormality determination unit 32 determines that the state is abnormal. In determining whether the state is abnormal, the first method or the second method is used as described above to avoid an incorrect determination and to detect an abnormal state.

The conveyor control unit 33 generates a command value, which controls the motor 202 of the belt conveyor 22, and sends the generated command value to the treadmill 2. If the abnormality determination unit 32 determines that the state is normal while the trainee 4 conducts walking training, the conveyor control unit 33 generates a command value, which rotates the motor 202 of the belt conveyor 22, and sends the generated command value to the treadmill 2. On the other hand, if the abnormality determination unit 32 determines that the state is abnormal while the trainee 4 conducts walking training, the conveyor control unit 33 generates a command value, which reduces the rotation speed of the motor 202 of the belt conveyor 22 to a rotation speed lower than that in the normal state, or a command value, which stops the rotation of the motor 202 of the belt conveyor 22, and sends the generated command value to the treadmill 2.

The robot control unit 34 generates a command value, which controls the motor 203 of the robot 23, and sends the generated command value to the treadmill 2. If the abnormality determination unit 32 determines that the state is normal while the trainee 4 conducts walking training, the robot control unit 34 generates a command value, which causes the robot 23 to perform the flexion movement at a predetermined time interval, and sends the generated command value to the treadmill 2. On other hand, if the abnormality determination unit 32 determines that the state is abnormal while the trainee 4 conducts walking training, the robot control unit 34 generates a command value, which causes the robot 23 to stop the flexion movement, and sends the generated command value to the treadmill 2.

The relief device control unit 35 generates a command value, which controls the motor 204 of the relief device 24, and sends the generated command value to the treadmill 2. After the trainee 4 wears the relief device 24, the relief device control unit 35 generates a command value, which pulls the relief device 24 upward, and sends the generated command value to the treadmill 2.

The storage unit 36 stores various types of information that is used by the control device 3 to control the treadmill 2. The storage unit 36 includes at least one storage device. The storage device is, for example, a memory or a hard disk drive.

More specifically, the storage unit 36 stores, in advance, sensor position information 301, sensor size information 302, and foot size information 303. The sensor position information 301 is the information indicating the position of each of the plurality of load sensors 201 on the frame 21. The sensor size information 302 is the information indicating the size of the load sensor 201.

The abnormality determination unit 32 uses the sensor position information 301 and the sensor size information 302 to calculate the length between the centers of the load distributions or the length of the whole of the load distributions. For example, when two pieces of the load distribution information from the two load sensors 201 each indicate a load distribution, the abnormality determination unit 32 determines whether there is another load sensor 201 between the two load sensors 201, based on the sensor position information 301. If it is determined that there is a load sensor 201 between the two load sensors 201, the abnormality determination unit 32 adds the length of the load sensor 201, which is present between the two load sensors 201, to the lengths in the load distributions detected by the two load sensors 201 to calculate the length between the centers of the load distributions or the length of the whole of the load distributions. In this case, the size of the load sensor 201, indicated by the sensor size information 302, is used for the length of the load sensors 201.

To identify the position of a load sensor 201, the sensor position information 301 is defined, for each of the plurality of load sensors 201, by associating an identifier, which uniquely identifies the load sensors 201, with the position of that load sensor 201. Each of the load sensors 201 sends the load distribution information with the identifier of that load sensor 201 included therein. This allows the abnormality determination unit 32 to identify the position of the load sensor 201, which has sent the load distribution information, from the identifier included in the load distribution information based on the sensor position information 301.

The foot size information 303 is the information indicating the size of the foot of the assistant 5. The size of the foot, indicated by the foot size information 303, is used when the predetermined size is defined as the size of the foot of the assistant 5 in the first method and the second method described above. In this case, the foot size information 303 is generated so that it indicates the size that the assistant 5 has entered into the control device 3 in advance via the input device (not shown) of the control device 3, and the generated foot size information 303 is stored in the storage unit 36. The foot size information 303 may also be generated so that it indicates the length of the load distribution detected by a load sensor 201 when only the assistant 5 gets on the frame 21 before starting walking training, and the generated foot size information 303 is stored in the storage unit 36.

Next, an example of a walking training procedure in the walking training system 1 in the first embodiment is described below with reference to FIGS. 6A to 6E. In FIGS. 6A to 6E, the state of the walking training system 1 viewed from side is shown in the left half and the state of the frame 21 and the belt conveyor 22 viewed from top is shown in the right half.

Figure 6A:
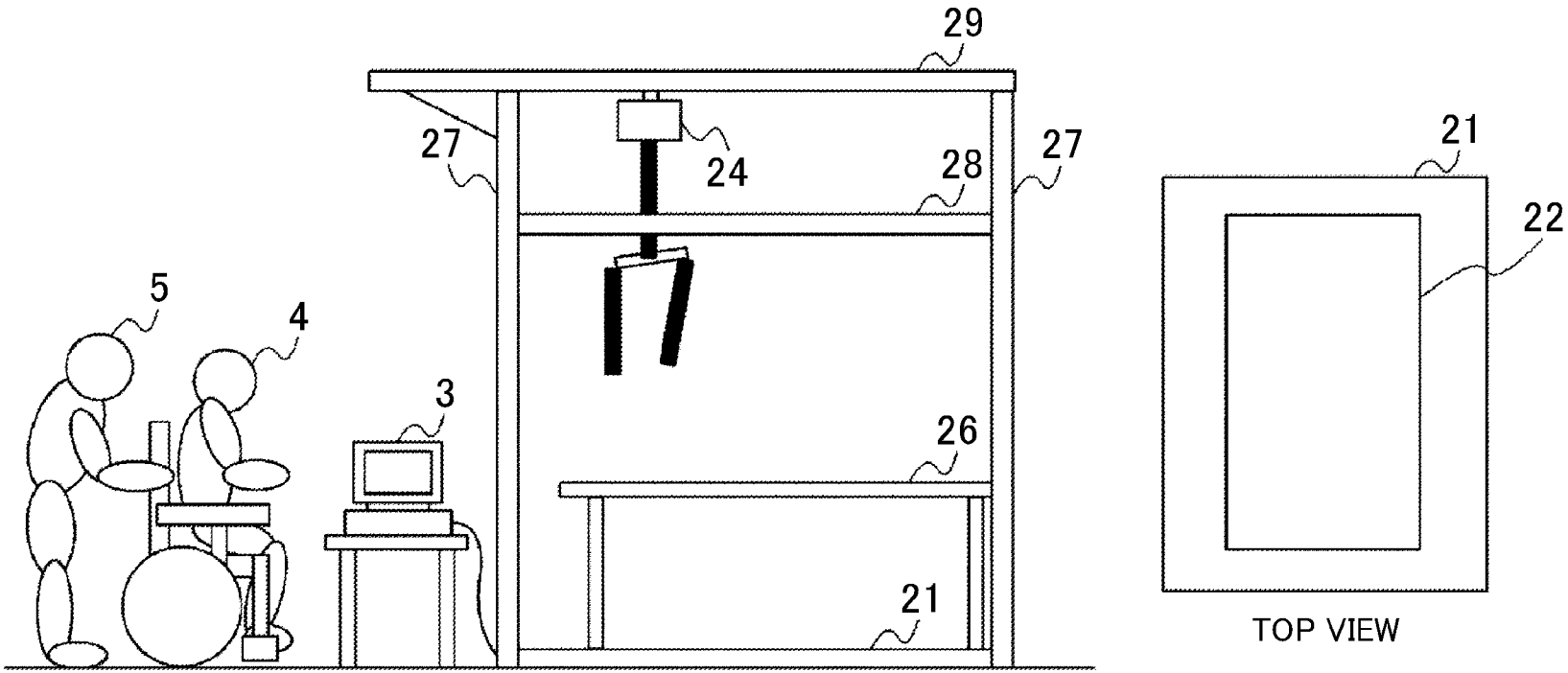
FIG. 6A is a diagram showing a walking training procedure in the first embodiment.

First, as shown in FIG. 6A, the trainee 4 comes near the treadmill 2 in a wheelchair. The wheelchair is moved by the assistant 5 to the side of the treadmill 2. At this time, there is nothing on the frame 21 and the belt conveyor 22.

Figure 6B:
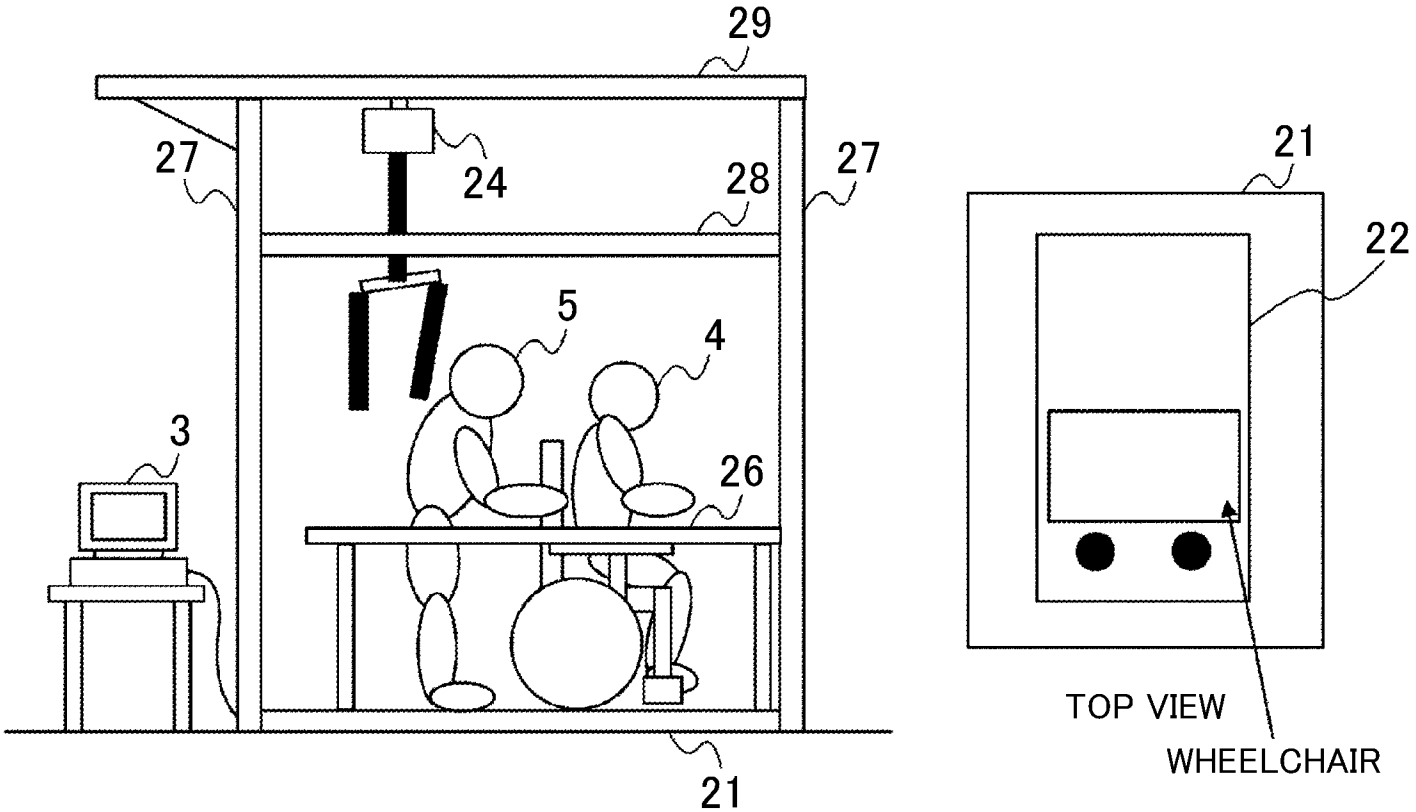
FIG. 6B is a diagram showing a walking training procedure in the first embodiment.

Next, as shown in FIG. 6B, the assistant 5 pushes the wheelchair, in which the trainee 4 is seated, and rides on the treadmill 2. Then, the wheelchair, in which the trainee 4 is seated, and the assistant 5 are on the belt conveyor 22. The load from the wheelchair and the two points of load from both feet of the assistant 5 behind the wheelchair are applied to the belt conveyor 22.

Figure 6C:
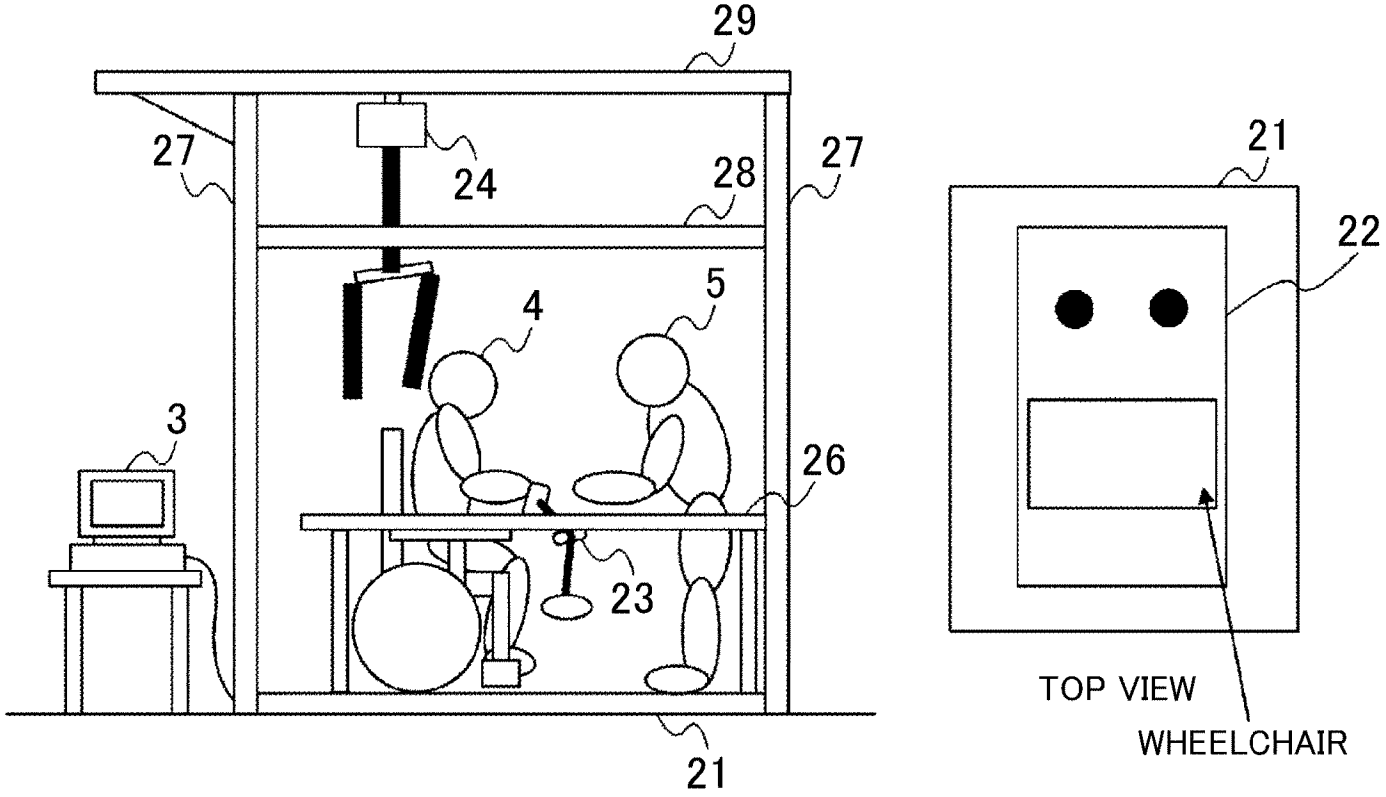
FIG. 6C is a diagram showing a walking training procedure in the first embodiment.

Next, as shown in FIG. 6C, the assistant 5 comes round in front of the trainee 4 and attaches the robot 23 to the affected leg of the trainee 4. At this time, the wheelchair, in which the trainee 4 is seated, and the assistant 5 are on the belt conveyor 22. On the belt conveyor 22, the two points of load from both feet of the assistant 5 are applied to the part in front of the wheelchair.

Figure 6D:
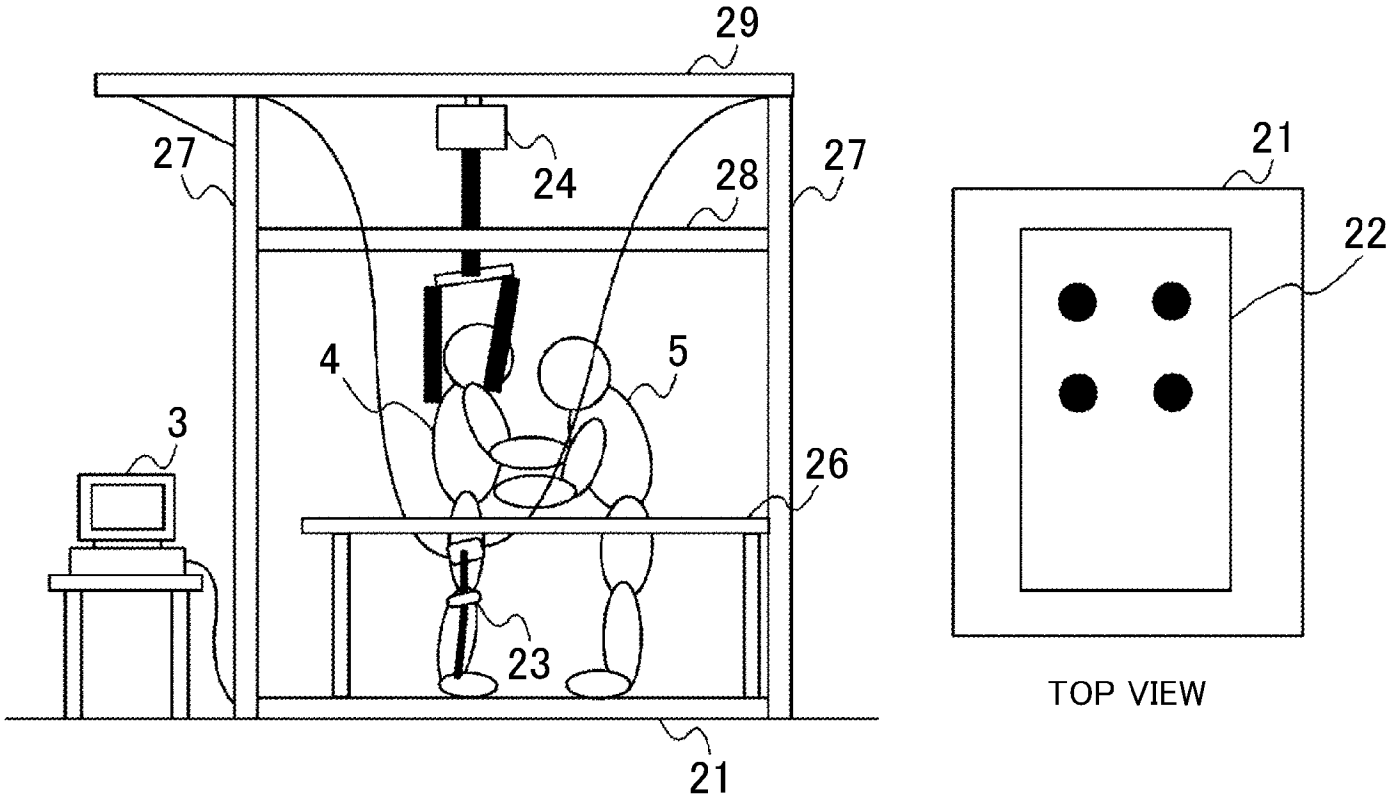
FIG. 6D is a diagram showing a walking training procedure in the first embodiment.

Next, as shown in FIG. 6D, the assistant 5 attaches the relief device 24 to the trainee 4 and raises the trainee 4. More specifically, the assistant 5 attaches the relief device 24 to the trainee 4 and enters an input, via the input device of the control device 3, to pull the relief device 24 upward. In response to the input from the assistant 5, the relief device control unit 35 of the control device 3 generates a command value, which pulls the relief device 24 upward, and sends the generated command value to the treadmill 2. This drives the motor 204 of the relief device 24 to cause the relief device 24 to raise the trainee 4 upward so that the trainee 4 can assume the standing posture. The assistant 5 moves the wheelchair out of the treadmill 2. At this time, the trainee 4 and the assistant 5 are on the belt conveyor 22. That is, the two points of load from both feet of the trainee 4 and the two points of load from both feet of the assistant 5, which are in front of the former, are applied to the belt conveyor 22.

Figure 6E:
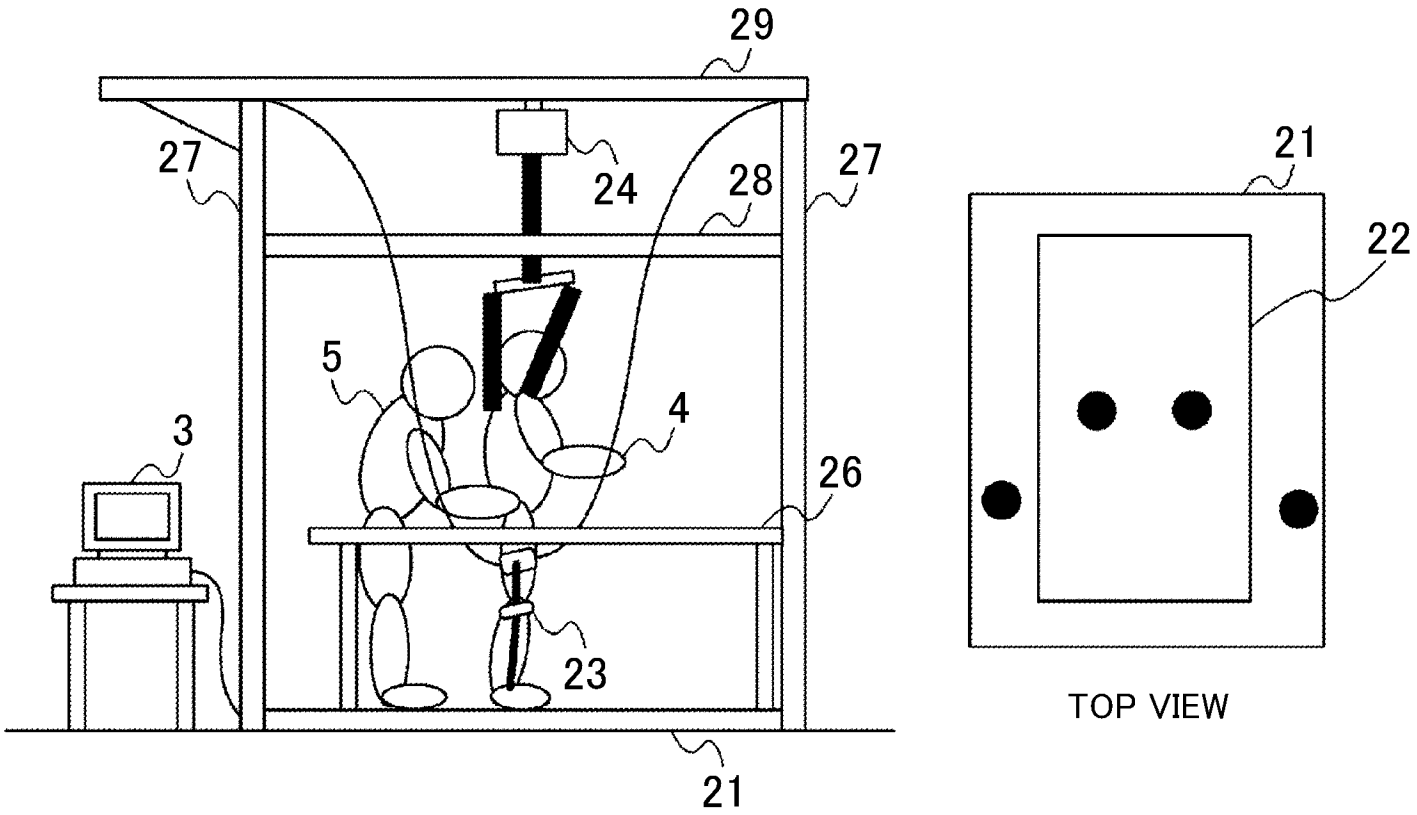
FIG. 6E is a diagram showing a walking training procedure in the first embodiment.

Next, as shown in FIG. 6E, the assistant 5 starts the walking training of the trainee 4. More specifically, the assistant 5 enters an input, via the input device of the control device 3, to start walking training. In response to the input from the assistant 5, the abnormality determination unit 32 of the control device 3 starts determining, based on the load distribution information received from the plurality of load sensors 201, whether an abnormal state is generated. In response to the input from the assistant 5, the conveyor control unit 33 of the control device 3 drives the motor 202 to move the trainee 4 backward via the belt conveyor 22. In response to the input from the assistant 5, the robot control unit 34 of the control device 3 starts controlling the motor 203 of the robot 23 so that the affected leg of the trainee 4 is flexed. The assistant 5 comes round behind the trainee 4 and stands on the frame 21 to support the trainee 4. At this time, so that the walking training is started after the assistant 5 supports the trainee 4, the control device 3 may start the above-described controls, which are performed responsive to the input, after a predetermined time has elapsed since the input, which indicates the start of walking training, is entered.

Figure 7:
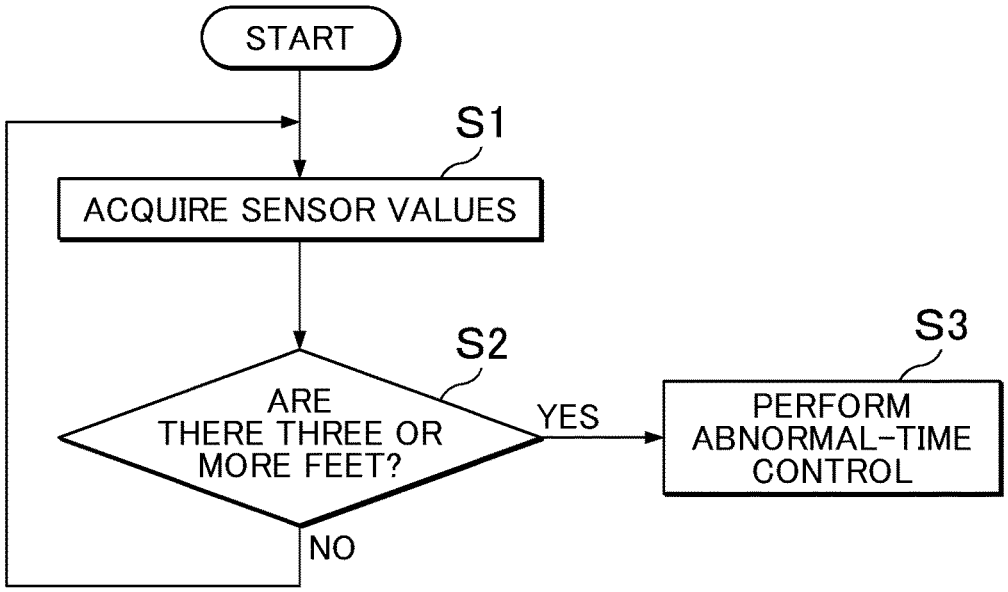
FIG. 7 is a flowchart showing the processing of the walking training system in the first embodiment.

Next, the processing of the walking training system 1 in the first embodiment is described with reference to FIG. 7.

The sensor value acquisition unit 31 receives the load distribution information sent from each of the plurality of load sensors 201 at a predetermined time interval (S1). The abnormality determination unit 32 determines whether there are three or more feet on the frame 21, based on the load distribution information received by the sensor value acquisition unit 31 (S2).

If it is determined that there are not three or more feet on the frame 21 (S2: No), the abnormality determination unit 32 determines that the state is normal and continues the determination based on the load distribution information received at a predetermined time interval (S1, S2). On the other hand, if it is determined that there are three or more feet on the frame 21 (S2: Yes), the abnormality determination unit 32 determines that an abnormal state is generated. In this case, the conveyor control unit 33 and the robot control unit 34 perform the abnormal-time control as described above (S3).

More specifically, the conveyor control unit 33 performs control to reduce the speed of the belt conveyor 22 or to stop the belt conveyor 22. The robot control unit 34 performs control to stop the operation of the robot 23.

A warning notification may be sent to the trainee 4 and the assistant 5. In this case, the treadmill 2 is required to have a warning device, and the control device 3 to have a warning device control unit. The warning device control unit sends instruction information to the warning device to instruct it to issue a warning notification. In response to the instruction information from the warning device control unit, the warning device notifies the trainee 4 and the assistant 5 about the warning. The warning may be notified by any method, either via light or via sound. When the warning is notified via light, an optical lamp is used as the warning device and the optical lamp is turned on in response to the instruction information from the control device 3. When the warning is notified via sound, a speaker is used as the warning device and a warning sound is output from the speaker in response to the instruction information from the control device 3.

In the first embodiment, the abnormality determination unit 32 determines whether there are three or more feet on the frame 21 based on the measurement result of the load sensors 201 as described above. If the abnormality determination unit 32 determines that there are three or more feet, the conveyor control unit 33 and the robot control unit 34 perform abnormal-time control. In this configuration, the situation, in which the trainee 4 loses balance during walking and gets out onto the frame 21, can be detected. That is, an abnormal state during walking training can be detected.

In the first embodiment, the load sensors 201 measure the load from the feet onto the frame 21, and the abnormality determination unit 32 determines that there are feet on the frame 21 when the load is measured by the load sensors 201. This implements a stain-resistant, low-cost system as compared to the case in which an optical sensor is used.

<Second embodiment of the present invention>Next, a second embodiment is described. In the description below, the same contents as those in the first embodiment are omitted as necessary. In the first embodiment, an example is described in which the load sensors 201 are arranged closely to each other in a grid pattern in all the range of the frame 21. However, because the assistant 5 supports the trainee 4 behind the trainee 4 with both hands, the range of the frame 21, in which the assistant 5 places the feet, is limited to a predetermined range on the backward side. In addition, because the trainee 4 is supported by the assistant 5 with both hands, the trainee 4 is positioned very near to the assistant 5. Therefore, when the trainee 4 loses balance and places his or her foot onto the frame 21, the foot of the trainee 4 is very likely to be positioned near to the foot of the assistant 5.

That is, in the first embodiment, when two load distributions are detected, it is determined whether those load distributions are generated by only the assistant 5 or by both the trainee 4 and assistant 5, based on the length of the two load distributions. In this case, the range in which such a determination is to be made is limited to a predetermined range in the backward part of the frame 21 where both trainee 4 and assistant 5 are likely to place the foot.

Figure 8:
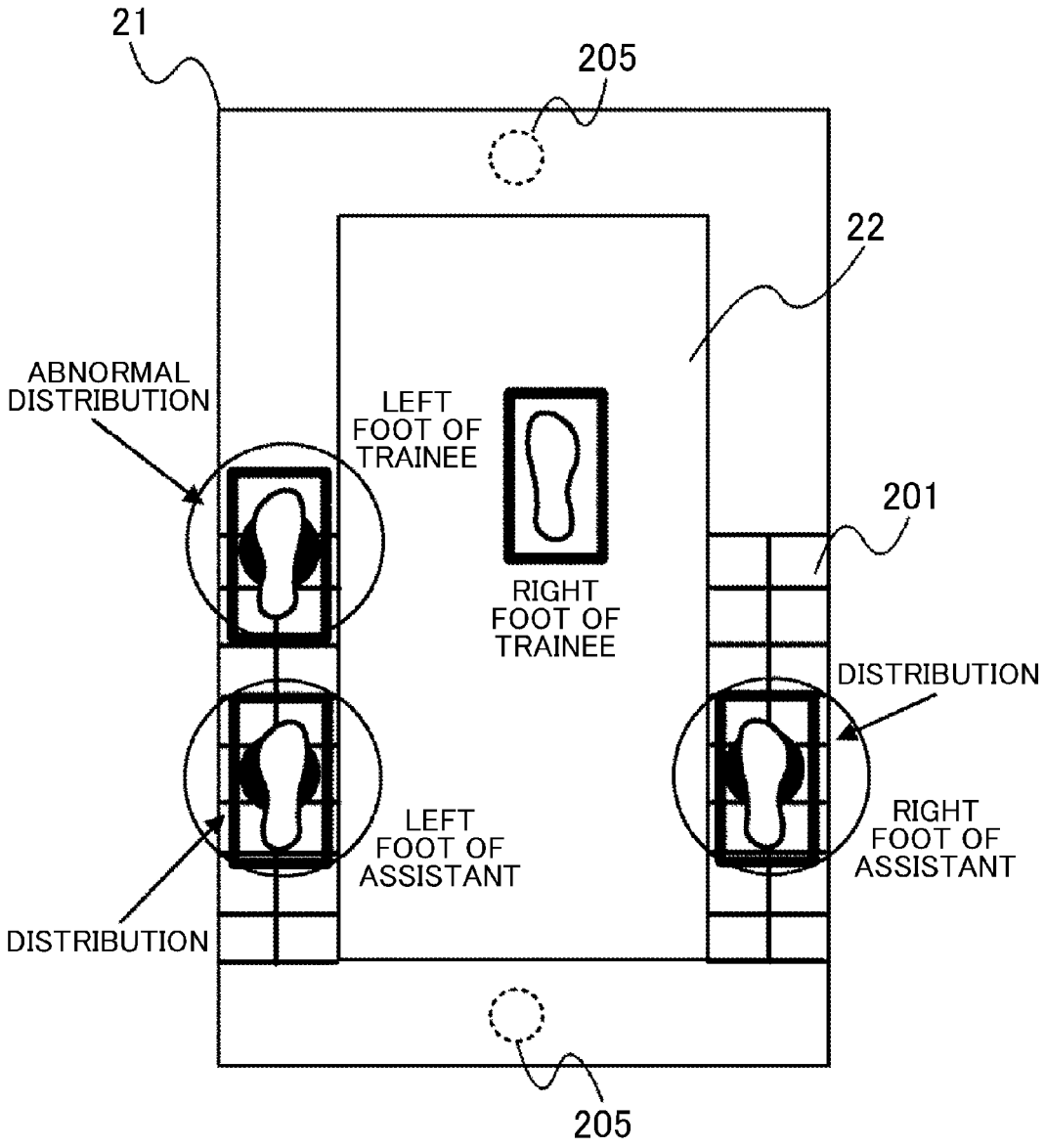
FIG. 8 is a top view showing a frame and a conveyor in a second embodiment.

To address this case, in the second embodiment, a plurality of load sensors 201 are arranged closely to each other in a grid pattern only in a predetermined range in the backward part of each of the right frame part and the left frame part of the frame 21, as shown in FIG. 8. This predetermined range is, for example, a range in the backward side of the intermediate position of the frame 21 in the front-back direction, but is not limited to that range. The method for determining whether there are three or more feet based on the load distributions detected by the plurality of the load sensors 201 is the same as that in the first embodiment and, therefore, the description is omitted.

In the second embodiment, the frame 21 has two ON/OFF sensors 205. The forward part of the frame 21 (the front frame part, and the range in the right frame part and the left frame part where the load sensors 201 are not arranged) is a plate component in the shape of the katakana symbol for "ko" and, under this forward part, one ON/OFF sensor 205 is arranged. Because of this, the ON/OFF sensor 205 is turned on when the foot is placed on the forward part (plate component in the shape of the katakana symbol for "ko") of the frame 21 and therefore the forward part is pushed, whereas the ON/OFF sensor 205 remains off when the foot is not placed on the forward part and therefore the forward part is not pushed.

There is a very low possibility that a load is applied to the forward part of the frame 21 by the assistant 5, whereas there is a very high possibility that a load is applied to the forward part when only the trainee 4 loses balance. Therefore, the application of a third point of load from the trainee 4 onto the forward part of the frame 21 can be detected simply by detecting, through the ON/OFF sensor 205, whether the forward part of the frame 21 is pushed.

In the second embodiment, the backward frame part of the frame 21 is also a plate component having the shape of the kanji symbol for "one" and, under this backward frame part, another ON/OFF sensor 205 is arranged. Because of this, the ON/OFF sensor 205 is turned on when the backward frame part of the frame 21 is pushed, whereas the ON/OFF sensor 205 remains off when the backward frame part is not pushed.

This structure also allows an abnormality to be detected that is caused when a third party, other than the trainee 4 and assistant 5, enters the treadmill 2 during walking training.

Figure 9:
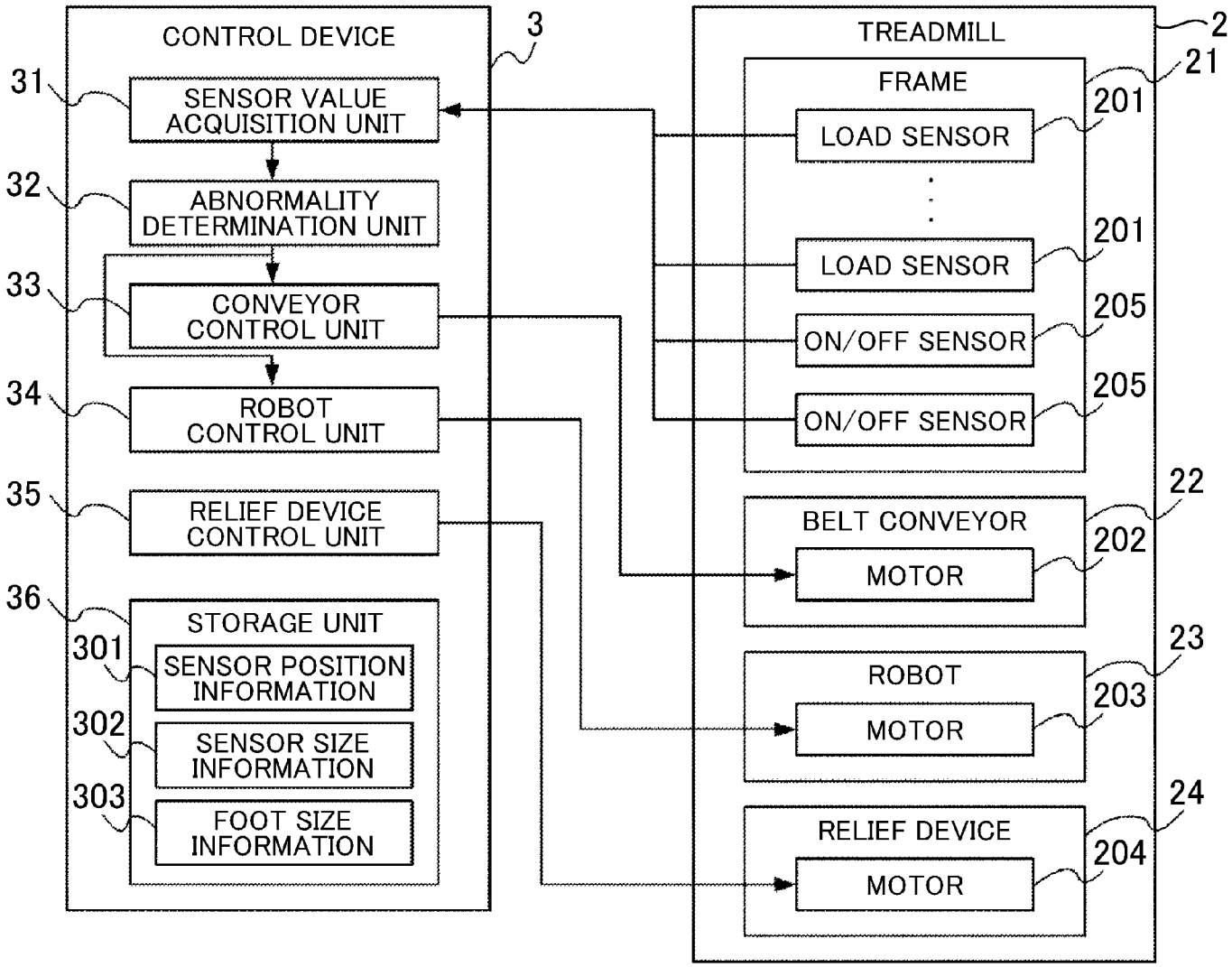
FIG. 9 is a diagram showing a configuration of the control system of the walking training system in the second embodiment.

Next, with reference to FIG. 9, the configuration of the control system of the walking training system 1 in the second embodiment is described. As shown in FIG. 9, the second embodiment is different from the first embodiment in that the frame 21 of the treadmill 2 further includes two ON/OFF sensors 205. In addition, the number of load sensors 201 in the second embodiment is smaller than that in the first embodiment as described above.

Each of the two ON/OFF sensors 205 sends the state notification information, which indicates that the sensor is in the OFF state, to the control device 3 if a foot is not placed on each of the forward part and the backward frame part of the frame 21 and therefore the sensor is OFF. On the other hand, each of the two ON/OFF sensors 205 sends the state notification information, which indicates that the sensor is in the ON state, to the control device 3 if a foot is placed on each of the forward part and the backward frame part of the frame 21 and therefore the sensor is ON. The ON/OFF sensor 205, a sensor that simply detects whether the state is ON or OFF, is more inexpensive than the load sensors 201 that detect a load distribution.

In the second embodiment, the sensor value acquisition unit 31 receives the load distribution information sent from the plurality of load sensors 201 as well as the state notification information sent from each of the two ON/OFF sensors 205.

In the second embodiment, the abnormality determination unit 32 determines whether there are three or more feet on the frame 21 based on the load distribution information received by the sensor value acquisition unit 31 as in the first embodiment. In addition, in the second embodiment, the abnormality determination unit 32 determines whether there are three or more feet on the frame 21 based on the state notification information received by the sensor value acquisition unit 31.

More specifically, the abnormality determination unit 32 determines that there are three or more feet on the frame 21 if at least one of the two pieces of state notification information indicates the ON state. That is, the abnormality determination unit 32 determines that the state is abnormal. This is because the ON state generated by pushing the ON/OFF sensor 205 is the state in which a person other than the assistant 5 places a foot on the frame 21 as described above. On the other hand, if both of the two pieces of state notification information indicate the OFF state, the abnormality determination unit 32 determines that there are not three or more feet on the frame 21. That is, the abnormality determination unit 32 determines that the state is normal (unless the state is determined as an abnormal state based on the load distribution information). The determination made by the abnormality determination unit 32 is not limited to the determination whether at least one of the two pieces of state notification information indicates the ON state. That is, if it is determined that there are two feet on the frame 21 based on the load distribution information received by the sensor value acquisition unit 31 and if at least one of the two pieces of state notification information indicates the ON state, the abnormality determination unit 32 may determine that there are three or more feet and, in other cases, may determine that there are not three or more feet.

In the second embodiment, a plurality of load sensors 201 are arranged close together on the frame 21 only in a predetermined range on the side in the direction opposite to the direction of movement of the trainee 4 (on the backward side). According to this configuration, the load sensors 201 are arranged only in a range, in which both the trainee 4 and the assistant 5 may place a foot, and the detailed determination is made based on the load distribution. Therefore, this reduces the number of load sensors 201 and lowers the cost without reducing detection accuracy.

In the second embodiment, the walking training system 1 has the ON/OFF sensors 205, which are turned on when a foot is placed and remains off when a foot is not placed, in a range on the frame 21 outside the range in which the plurality of load sensors 201 are arranged. If it is determined that there are two feet on the frame 21 based on the measurement result of the plurality of load sensors 201 and if the ON/OFF sensor 205 is turned on, the abnormality determination unit 32 determines that there are three or more feet on the frame 21. This configuration has inexpensive ON/OFF sensors 205 arranged only in the range, in which only the trainee 4 is likely to place a foot, to detect the presence of the foot of the trainee 4, thus reducing the cost without reducing detection accuracy.

<Third embodiment of the present invention>Next, a third embodiment is described. In the description below, the same contents as those in the first embodiment are omitted as necessary. In the first embodiment, it is determined that an abnormal state is detected if there are three or more feet on the frame 21. However, when the assistant 5 loses balance and steps into the belt conveyor 22, it becomes difficult for the assistant 5 to support the trainee 4 and for the trainee 4 to continue walking training. In the third embodiment, a walking training system 1 that can detect such a condition as an abnormal state is described.

Figure 10:
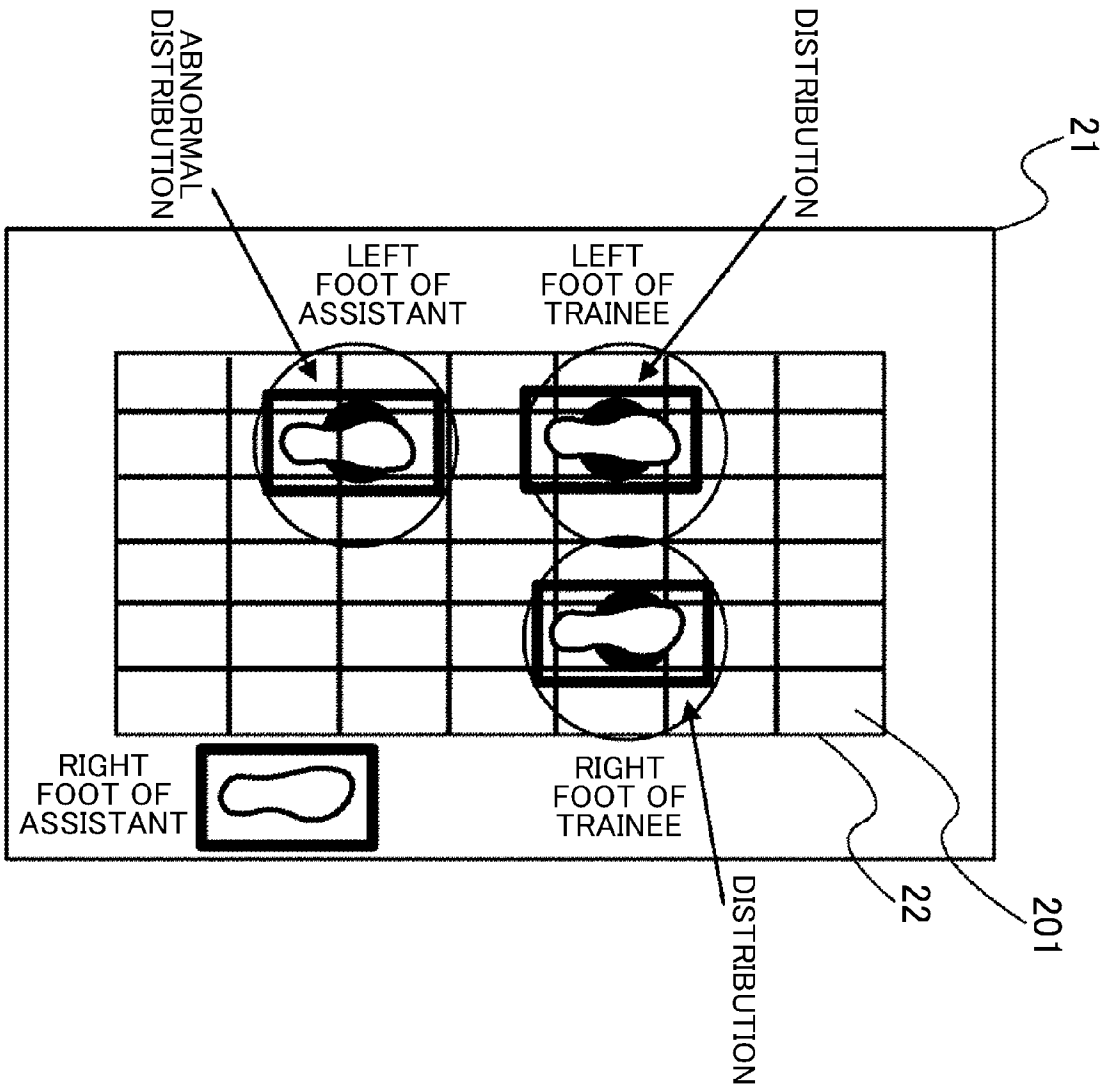
FIG. 10 is a top view showing a frame and a conveyor in a third embodiment.

The third embodiment is different from the first embodiment in that the plurality of load sensors 201 are arranged, not on the frame 21, but on the belt conveyor 22. The load sensors 201 are arranged below the upper belt of the belt conveyor 22. This allows a load to be detected also on the belt that moves. The plurality of load sensors 201 are arranged in a grid pattern in the range that is on the belt conveyor 22 and is surrounded by the frame 21, as shown in FIG. 10.

The abnormal state detection method and the abnormal-time processing to be performed for an abnormal state are the same as those in the first embodiment and, therefore, the description is omitted.

In the third embodiment, the abnormality determination unit 32 determines whether there are three or more feet on the belt conveyor 22, based on the measurement result of the load sensors 201, as described above. If the abnormality determination unit 32 determines that there are three or more feet, the conveyor control unit 33 and the robot control unit 34 perform abnormal-time control. This allows the situation, in which the assistant 5 steps off from the frame 21, to be detected. That is, an abnormal state during walking training can be detected.

The third embodiment may be performed by combining it with the first embodiment or the second embodiment. That is, in the first embodiment or the second embodiment, a determination may be made whether there are three or more feet on the belt conveyor 22 as described in the third embodiment.

In this case, in the first embodiment or the second embodiment, a determination may be made whether there are three or more feet on the belt conveyor 22 without combining the embodiment with the third embodiment. That is, if a load distribution is detected only in one point on the frame 21 or if no load distribution is detected on the frame 21, the abnormality determination unit 32 may determine that the foot of the assistant 5 enters the belt conveyor 22 and therefore there are three or more feet on the belt conveyor 22. If the abnormality determination unit 32 determines that there are three or more feet on the belt conveyor 22, the conveyor control unit 33 and the robot control unit 34 may perform abnormal-time processing.

<Fourth embodiment of the present invention>Next, a fourth embodiment is described. In the description below, the same contents as those in the first embodiment are omitted as necessary. In the first to third embodiments, a determination is made whether a foot is present at three or more points on the frame 21 or on the belt conveyor 22, using the load measured by the load sensors 201. However, the contents measured in order to determine the presence of a foot on the frame 21 and the belt conveyor 22 are not limited to the load. The other contents may also be measured if it is possible to determine whether there are three or more feet on the frame 21 or the belt conveyor 22. In the fourth embodiment, an example is described in which the presence of a foot on the frame 21 or the belt conveyor 22 is measured by infrared sensors.

Figure 11:
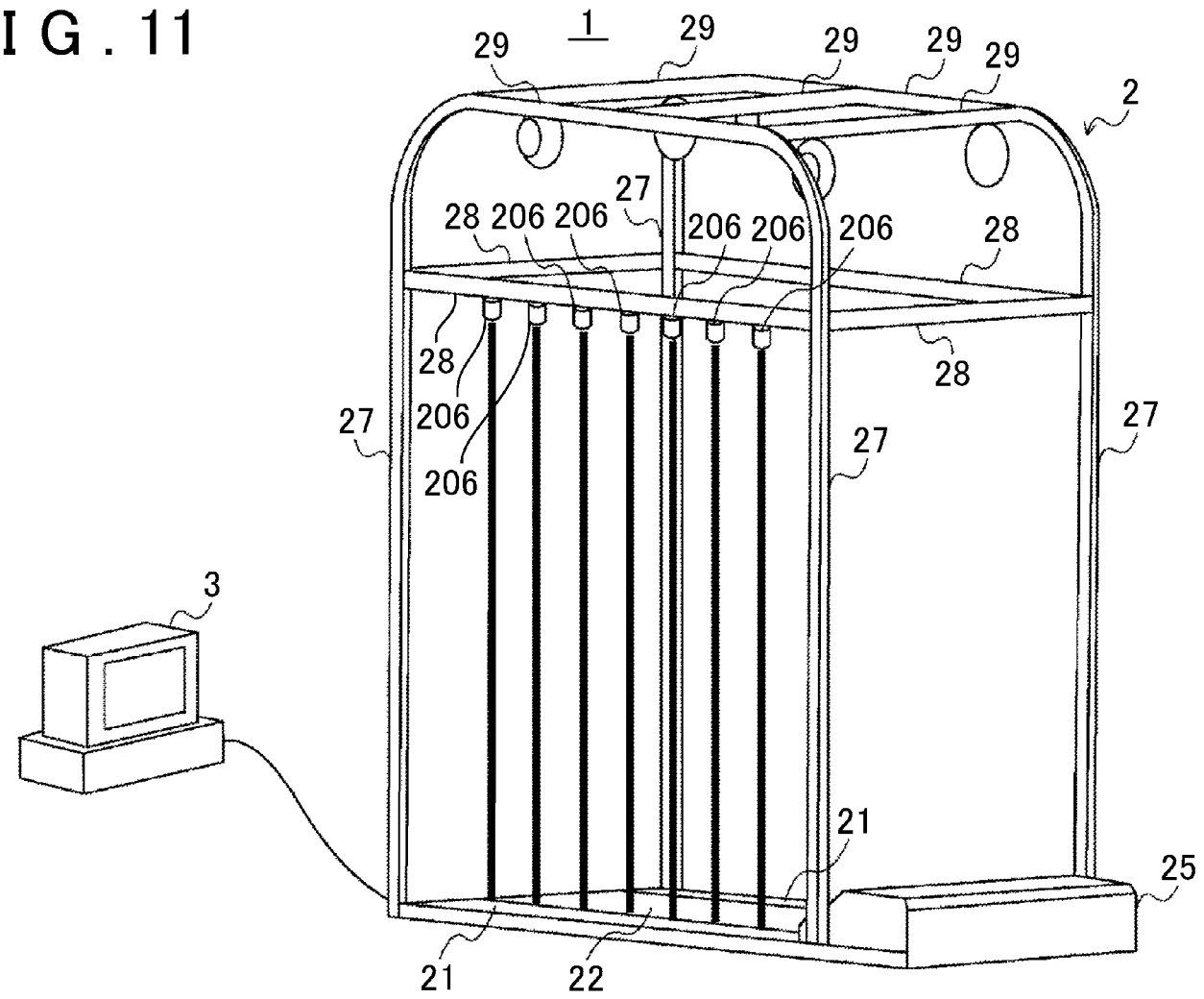
FIG. 11 is a diagram showing a configuration of a walking training system in a fourth embodiment.

The configuration of a walking training system 1 in the fourth embodiment is described with reference to FIG. 11. As shown in FIG. 11, the fourth embodiment is different from the first embodiment in that the treadmill 2 has a plurality of infrared sensors 206 instead of a plurality of load sensors 201. To make the feature of the fourth embodiment clearer, the trainee 4, assistant 5, robot 23, relief device 24, and handrail 26 are not shown in FIG. 11.

The plurality of infrared sensors 206 are installed in such a manner that the infrared sensors observe the boundary between the frame 21 and the belt conveyor 22 from above. The plurality of infrared sensors 206 are installed in such a manner that the infrared sensors each observe the boundary between the frame 21 and the belt conveyor 22 at a predetermined interval. For example, the interval of the observation points on the boundary between the frame 21 and the belt conveyor 22 is the same as the interval at which the plurality of infrared sensors 206 are arranged. For example, the plurality of infrared sensors 206 are arranged in a row on the bottom of the upper frame component 28 as shown in FIG. 11 so that the infrared sensors are parallel to the boundary between the frame 21 and the belt conveyor 22. This upper frame component 28 is, for example, the one that couples the vertical frame component 27 in the right front position to that in the right rear position. The arrangement of the plurality of infrared sensors 206 is not limited to that exemplified in FIG. 11 as long as the boundary between the frame 21 and the belt conveyor 22 can be observed. For example, the plurality of infrared sensors may be arranged on the upper frame component 29 or on other components on the treadmill 2.

To make the arrangement of the infrared sensors 206 clearer, only the plurality of infrared sensors 206, which observe the boundary between the right frame part of the frame 21 and the belt conveyor 22, are shown in FIG. 11. The treadmill 2 also has a plurality of infrared sensors 206 that observe the boundary between the left frame part of the frame 21 and the belt conveyor 22.

Figure 12:
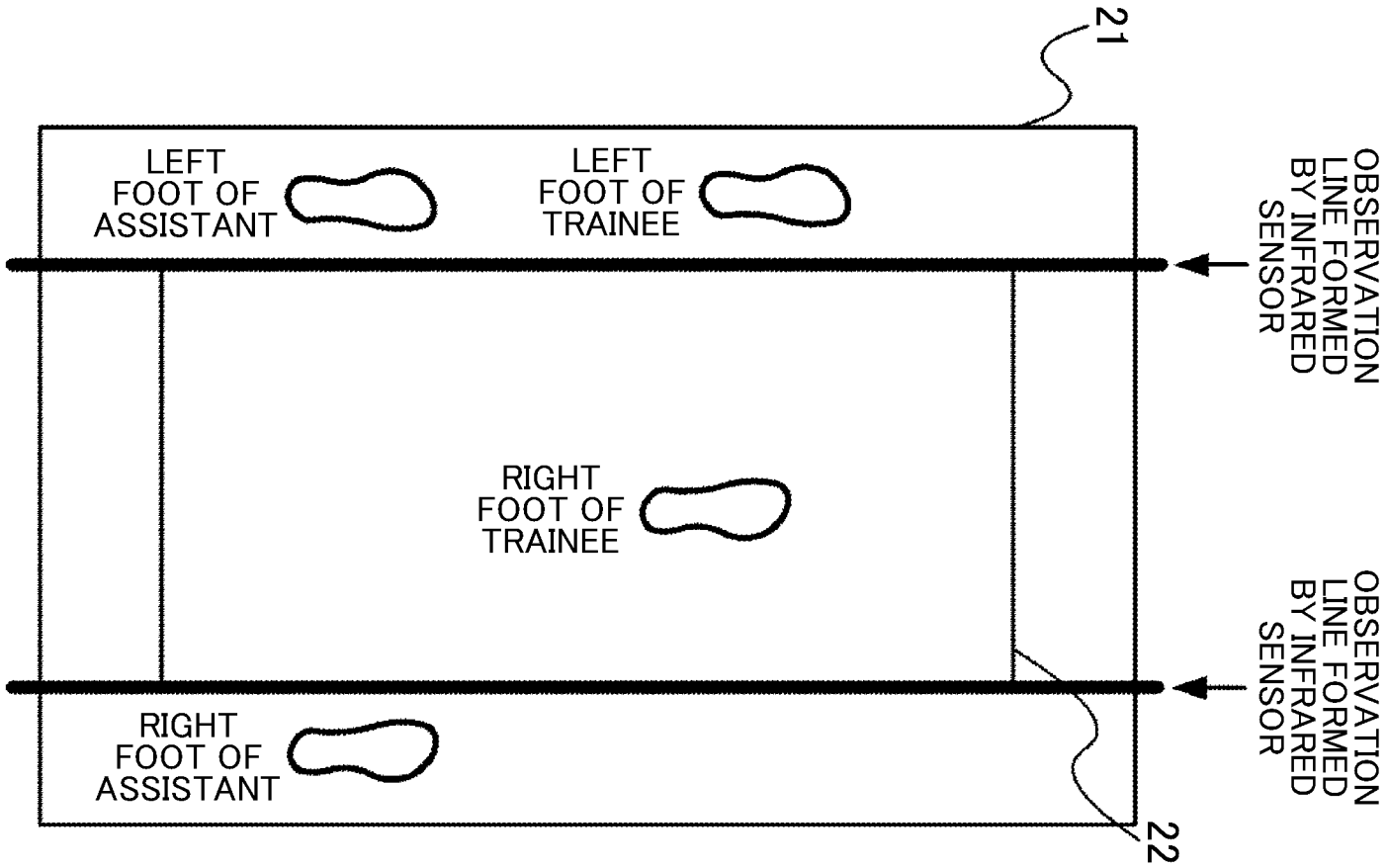
FIG. 12 is a top view showing a frame and a conveyor in the fourth embodiment.

Next, the abnormality detection method of the walking training system 1 in the fourth embodiment is described with reference to FIGS. 12 to 15. FIG. 12 is a top view showing the frame 21 and the conveyor 22.

As described above, the treadmill 2 has a plurality of infrared sensors 206 in such a manner that each of the boundary between the right frame part of the frame 21 and the belt conveyor 22 and the boundary between the left frame part of the frame 21 and the belt conveyor 22 is observed. Therefore, the observation line of the plurality of infrared sensors 206 is formed on each of the boundary between the right frame part of the frame 21 and the belt conveyor 22 and the boundary between the left frame part of the frame 21 and the belt conveyor 22.

According to this configuration, while the trainee 4 conducts walking training normally, the observation line of the infrared sensors 206 is blocked at two positions, one at the right foot and the other at the left foot of the assistant 5. On the other hand, when the trainee 4 loses balance and one foot of the trainee 4 gets out onto the frame 21, the observation line of the infrared sensors 206 is blocked at three positions. That is, when the blocking of the infrared light is detected by the infrared sensors 206, the walking training system 1 determines that there is a foot on the frame 21.

Therefore, if the observation line of the infrared sensors 206 is blocked at three or more positions, the walking training system 1 basically determines that there are three or more feet on the frame 21. This is the state in which the trainee 4 loses balance and one foot of the trainee 4 gets out onto the frame 21, which is outside the belt conveyor 22, as shown in FIG. 12.

Figure 13:
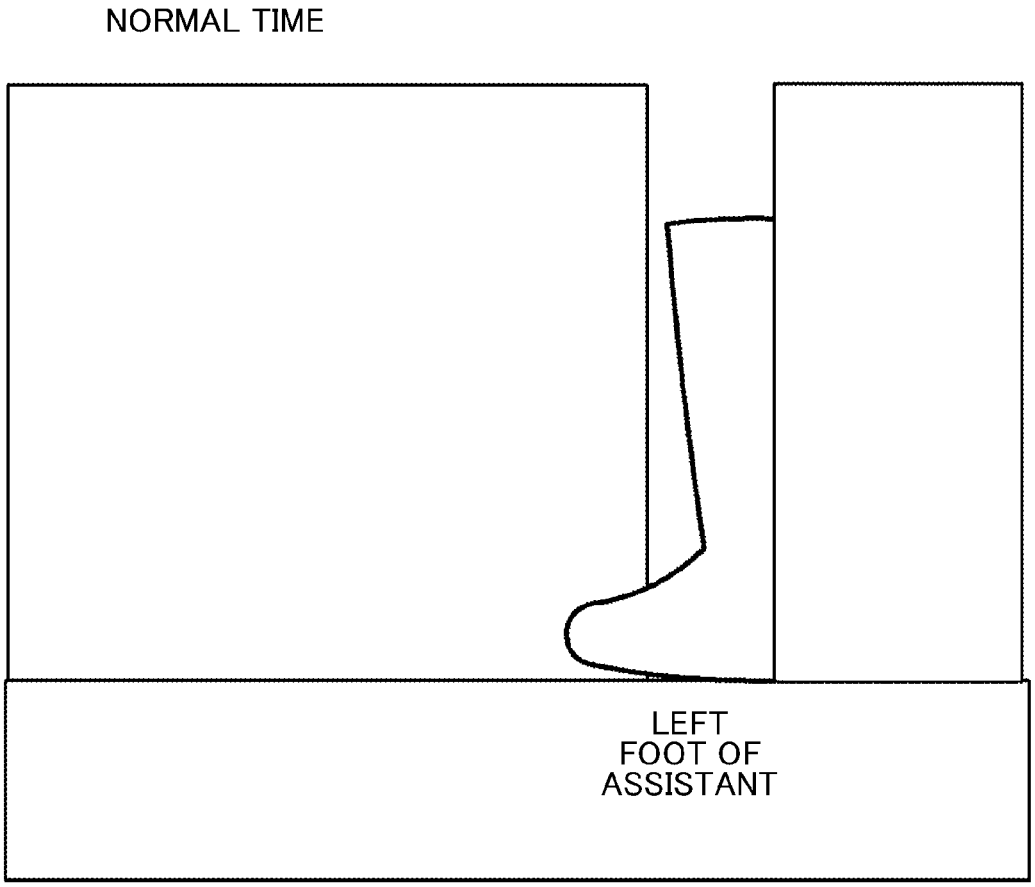
FIG. 13 is a diagram showing an example in which an infrared sensor observation line is blocked in the fourth embodiment.
Figure 14:
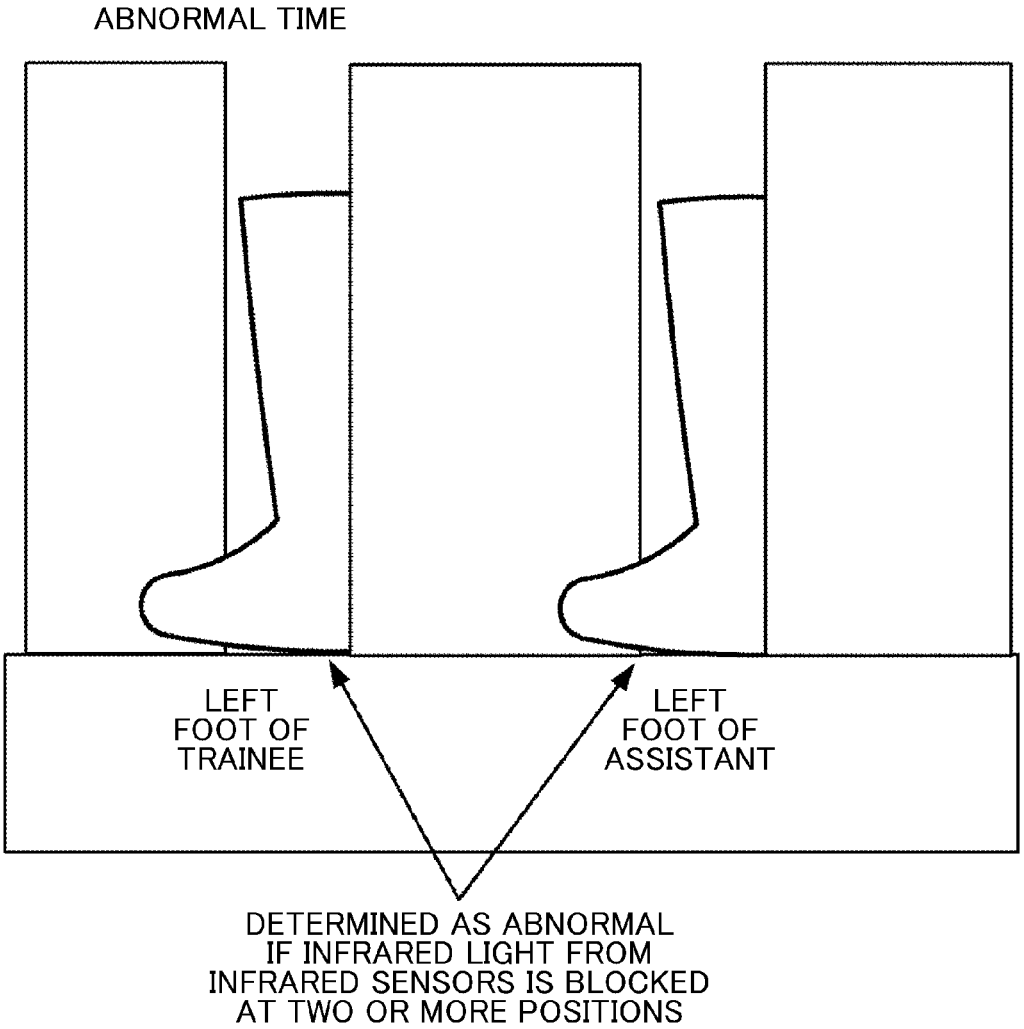
FIG. 14 is a diagram showing an example in which an infrared sensor observation line is blocked in the fourth embodiment.
Figure 15:
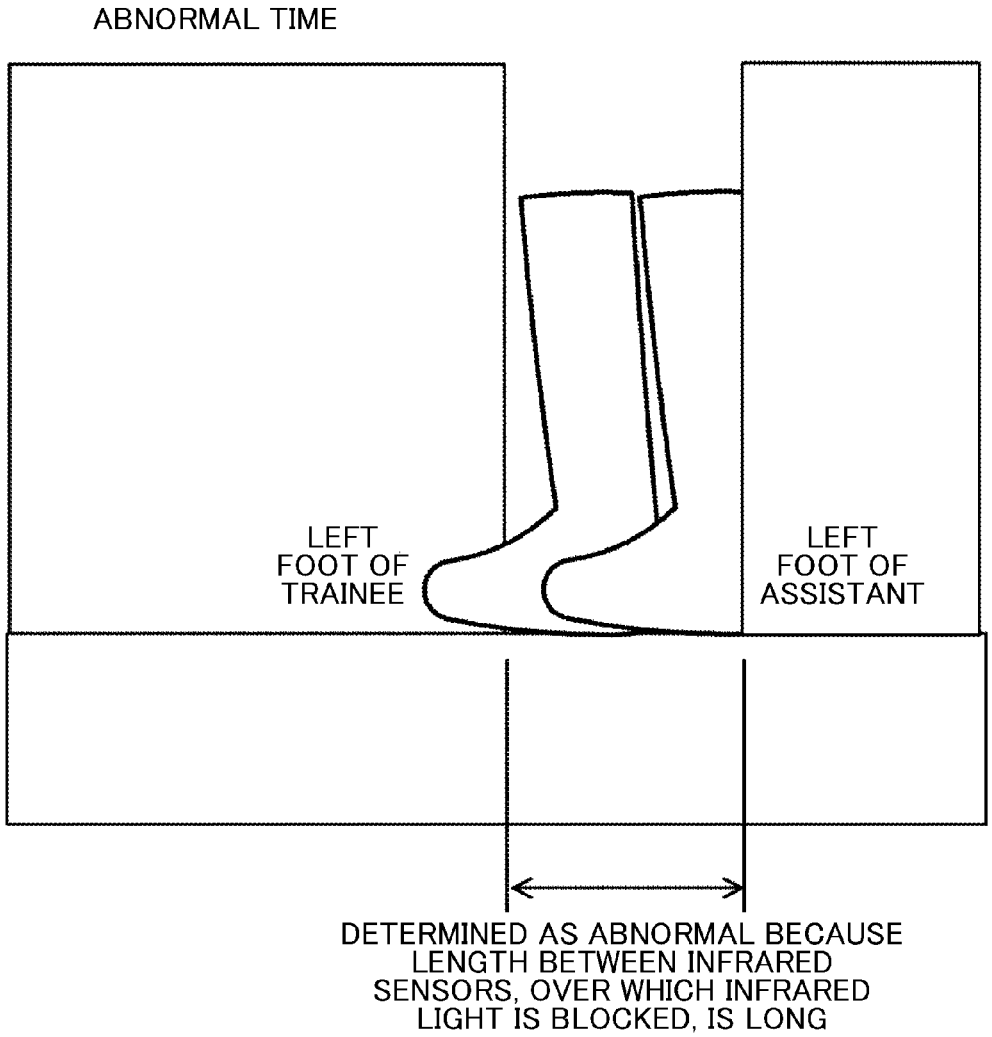
FIG. 15 is a diagram showing an example in which an infrared sensor observation line is blocked in the fourth embodiment.

A more specific example is described with reference to FIGS. 13 to 15. FIGS. 13 to 15 are diagrams showing an example of the state of the observation line in the boundary between the left frame of the frame 21 and the belt conveyor 22. In the description below, it is assumed that the observation line in the boundary between the right frame part of the frame 21 and the belt conveyor 22 is blocked at one position by the right foot of the assistant 5.

If the observation line in the boundary between the left frame part of the frame 21 and the belt conveyor 22 is blocked at one position by the left foot of the assistant 5 as shown in FIG. 13, the observation line of the infrared sensors 206 is blocked at a total of two positions, one by the right foot and the other by the left foot. In this case, the walking training system 1 determines that the state is normal.

If the observation line in the boundary between the left frame part of the frame 21 and the belt conveyor 22 is blocked at two positions, one by the left foot of the trainee 4 and the other by the left foot of the assistant 5, as shown in FIG. 14, the observation line of the infrared sensors 206 is blocked at a total of three positions. In this case, the walking training system 1 determines that the state is abnormal.

If the left foot of the trainee 4 and the left foot of the assistant 5 are close to each other as shown in FIG. 15 and if the observation line in the boundary between the left frame part of the frame 21 and the belt conveyor 22 is blocked by the left foot of the trainee 4 and the left foot of the assistant 5, the observation line appears to be blocked at one position in some cases. That is, the observation line of the infrared sensors 206 appears to be blocked at a total of two positions in some cases. For example, in this case, the infrared line of the consecutive infrared sensors 206 is blocked.

In this case, if no consideration is given to this condition, the state may be determined incorrectly as a normal state regardless of the fact that the trainee 4 places a foot on the frame 21. To solve this problem, the method described below is used in the fourth embodiment to avoid such an incorrect determination.

Each of the plurality of infrared sensors 206 focuses an infrared light onto the boundary between the frame 21 and the belt conveyor 22 to detect whether the focused infrared line is blocked by a foot. Each of the plurality of infrared sensors 206 is, for example, a reflection type infrared sensor 206.

If the infrared light from two or more nonconsecutive infrared sensors 206 is blocked in the observation line, the control device 3 determines that the observation line is blocked at two or more positions. This is the case such as that shown in FIG. 14.

If the infrared light from two or more consecutive infrared sensors 206 is blocked in the observation line, the control device 3 determines whether the length between the two infrared sensors 206 at both ends, which are included in the two or more infrared sensors 206 the infrared line of which is blocked, is longer than a predetermined length. In other words, the control device 3 determines whether the length, over which the infrared light is blocked, is longer than the predetermined length. If it is determined that the length between the two infrared sensors 206 is longer than the predetermined length, the control device 3 determines that the infrared light is blocked at two or more positions by each of the foot of the trainee 4 and the foot of the assistant 5. In other words, the control device 3 determines that there are the foot of the trainee 4 and the foot of the assistant 5 on the frame 21. This is the case such as that shown in FIG. 15. On the other hand, if it is determined that the length between the two infrared sensors 206 is equal to or shorter than the predetermined length, the control device 3 determines that the infrared light is blocked at one position by the foot of the assistant 5 only. In other words, the control device 3 determines that there is the foot of only the assistant 5 on the frame 21. This is the case such as that shown in FIG. 13.

The predetermined length described above may be any value that is long enough to distinguish between the length, over which the infrared light is blocked by the foot of the trainee 4 and the foot of the assistant 5, and the length over which the infrared light is blocked by the assistant 5 only. Preferably, the size of the foot of the assistant 5 is set.

Figure 16:
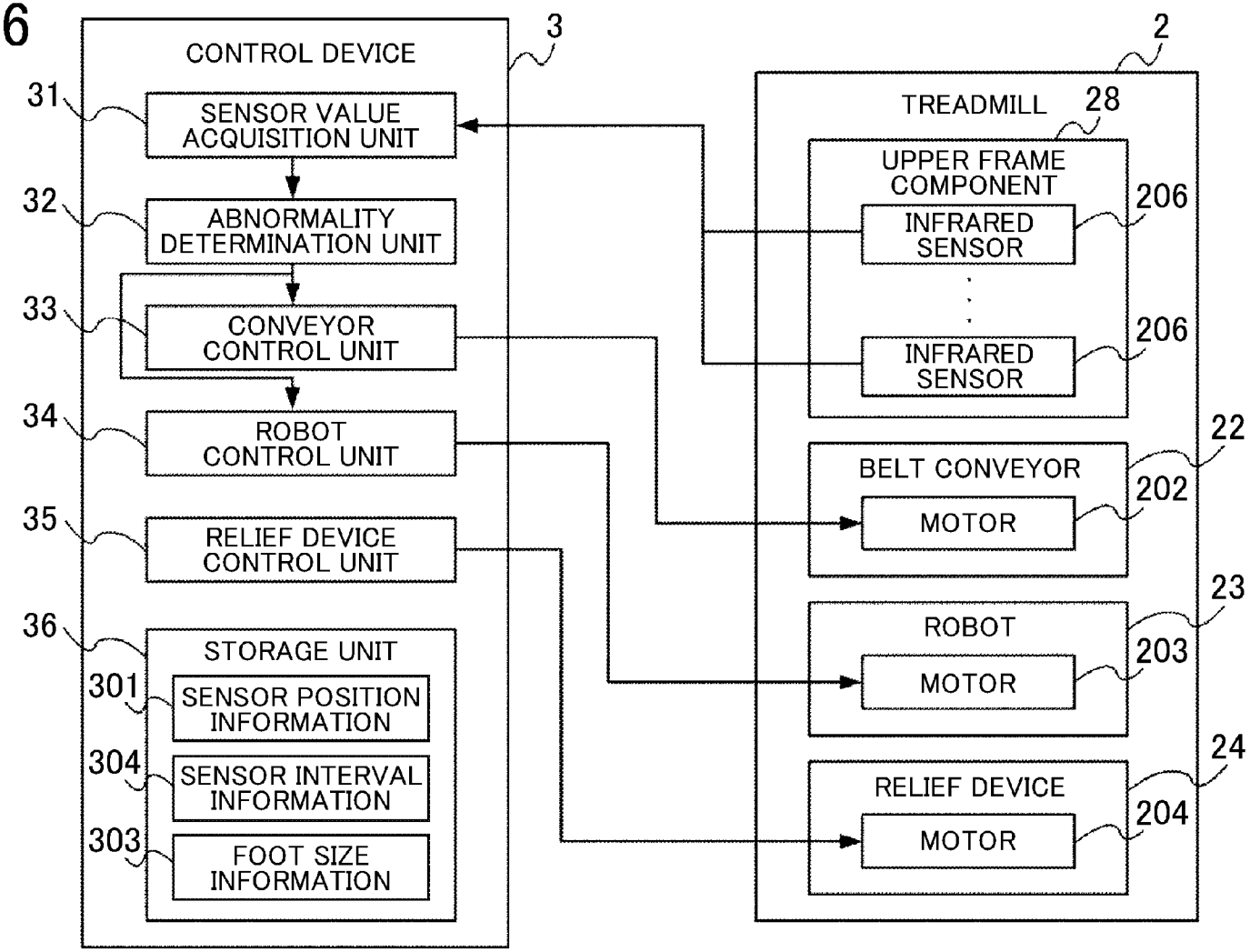
FIG. 16 is a diagram showing a configuration of the control system of the walking training system in the fourth embodiment.

Next, the configuration of the control system of the walking training system 1 in the fourth embodiment is described below with reference to FIG. 16. As shown in FIG. 16, the fourth embodiment is different from the first embodiment in that, in the treadmill 2, the frame 21 has not a plurality of load sensors 201 but the upper frame component 28 has a plurality of infrared sensors 206.

Each of the plurality of infrared sensors 206 sends the state notification information, which indicates whether the infrared light is blocked, to the control device 3. The fourth embodiment is different from the first embodiment in that the sensor value acquisition unit 31 receives the state notification information sent from the plurality of infrared sensors 206 instead of the load distribution information sent from the plurality of load sensors 201.

In the fourth embodiment, the abnormality determination unit 32 determines whether there are three or more feet on the frame 21 based on the state notification information received by the sensor value acquisition unit 31. That is, the abnormality determination unit 32 determines whether the infrared light is blocked at three or more positions. If it is determined that the infrared light is not blocked at three or more positions, the abnormality determination unit 32 determines that the state is normal. On the other hand, if it is determined that the infrared light is blocked at three or more positions, the abnormality determination unit 32 determines that the state is abnormal.

In the fourth embodiment, sensor interval information 304, not the sensor size information 302, is stored in advance. In addition, in the fourth embodiment, the sensor position information 301 is the information indicating the positions of the plurality of infrared sensors 206 on the upper frame component 28.

Therefore, the abnormality determination unit 32 uses the sensor position information 301 and the sensor interval information 304 to determine whether the infrared light is blocked at three or more positions. For example, based on the sensor position information 301, the abnormality determination unit 32 determines whether the infrared sensors 206, the infrared light of which is blocked, are arranged consecutively. In addition, when calculating the length between two infrared sensors 206, the abnormality determination unit 32 uses the sensor position information 301 to calculate the number of infrared sensors 206 between the two infrared sensors 206. After that, the abnormality determination unit 32 uses the sensor interval information 304 to calculate the length, which corresponds to the number of infrared sensors 206, as the distance between the two infrared sensors 206. That is, ((the number of infrared sensors 206 between the two infrared sensors 206+1)×the length between the infrared sensors 206 indicated by sensor interval information 304) is calculated as the length between the two infrared sensors 206.

To identify the position of an infrared sensor 206, the sensor position information 301 is created, for each of the plurality of infrared sensors 206, by associating an identifier, which uniquely identifies the infrared sensor 206, with the position of that infrared sensor 206, as in the first embodiment. Each of the infrared sensors 206 sends the state notification information with the identifier of that infrared sensor 206 included therein. This allows the abnormality determination unit 32 to identify the position of the infrared sensor 206, which has sent the state notification information, from the identifier included in the state notification information based on the sensor position information 301.

The foot size information 303 is the same as that in the first embodiment. That is, the foot size information 303 is used when the predetermined length described above is set to the foot size of the assistant 5.

While an example, in which the infrared sensors 206 are used as photo-electronic sensors for measuring the presence state of a foot, has been described, the present invention is not limited to this example. Reflection type photo-electronic sensors, which measure the presence state of a foot using a light other than an infrared light, may also be used.

As described above, the fourth embodiment has the plurality of infrared sensors 206 for measuring the boundary between the belt conveyor 22 and the frame 21. If the blocking of the infrared light is detected by the infrared sensors 206, it is determined that there is a foot on the frame 21. In this way, an abnormal state during walking training may also be detected by a sensor other than the load sensor 201.

In addition, in the fourth embodiment, if the infrared light is blocked only at one position or if the infrared light is not blocked at all, the abnormality determination unit 32 may determine that a foot of the assistant 5 enters the belt conveyor 22 and, as a result, there are three or more feet on the belt conveyor 22. If the abnormality determination unit 32 determines that there are three or more feet on the belt conveyor 22, the conveyor control unit 33 and the robot control unit 34 may perform abnormal-time processing.

<Fifth embodiment of the present invention>Next, a fifth embodiment is described. In the description below, the same contents as those in the first embodiment are omitted as necessary. In the fourth embodiment, though an example is described in which a measurement result, produced by the infrared sensors 206, is used as the contents for measuring, not via a load, the presence state of a foot on the frame 21 or on the belt conveyor 22, other measurement contents may also be used. In the fifth embodiment, an example is described in which the presence state of a foot on the frame 21 or a belt conveyor 22 is measured by a camera.

Figure 17:
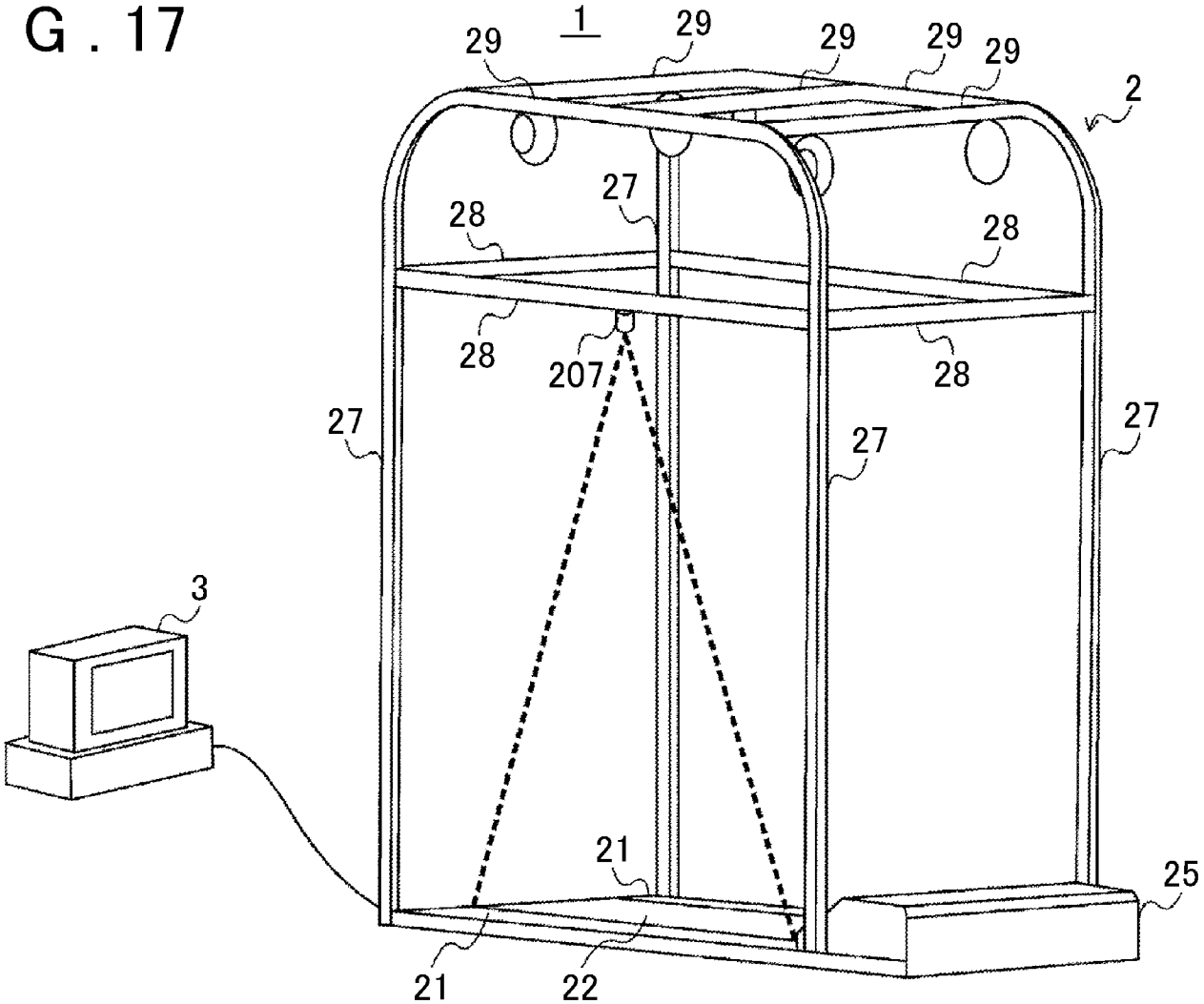
FIG. 17 is a diagram showing a configuration of a walking training system in a fifth embodiment.

The configuration of a walking training system 1 in the fifth embodiment is described with reference to FIG. 17. As shown in FIG. 17, the fifth embodiment is different from the first embodiment in that the treadmill 2 has a camera 207 instead of the plurality of load sensors 201. To make the feature of the fifth embodiment clearer, the trainee 4, assistant 5, robot 23, relief device 24, and handrail 26 are not shown in FIG. 17.

The camera 207 is installed so that it observes the frame 21 from above. The camera 207 is installed, for example, on the bottom of the upper frame component 28 as shown in FIG. 17. This upper frame component 28 is, for example, the one that couples the vertical frame component 27 in the right front position to the vertical frame components 27 in the right rear position. The arrangement of the camera 207 is not limited to that exemplified in FIG. 17 as long as the frame 21 can be observed. For example, the camera may be arranged on the upper frame component 29 or on other components on the treadmill 2.

Although only the camera 207 that observes the right frame part of the frame 21 is shown in FIG. 17 to make the arrangement of the camera 207 clearer, the treadmill 2 also has the camera 207 that observes the left frame part of the frame 21.

Figure 18:
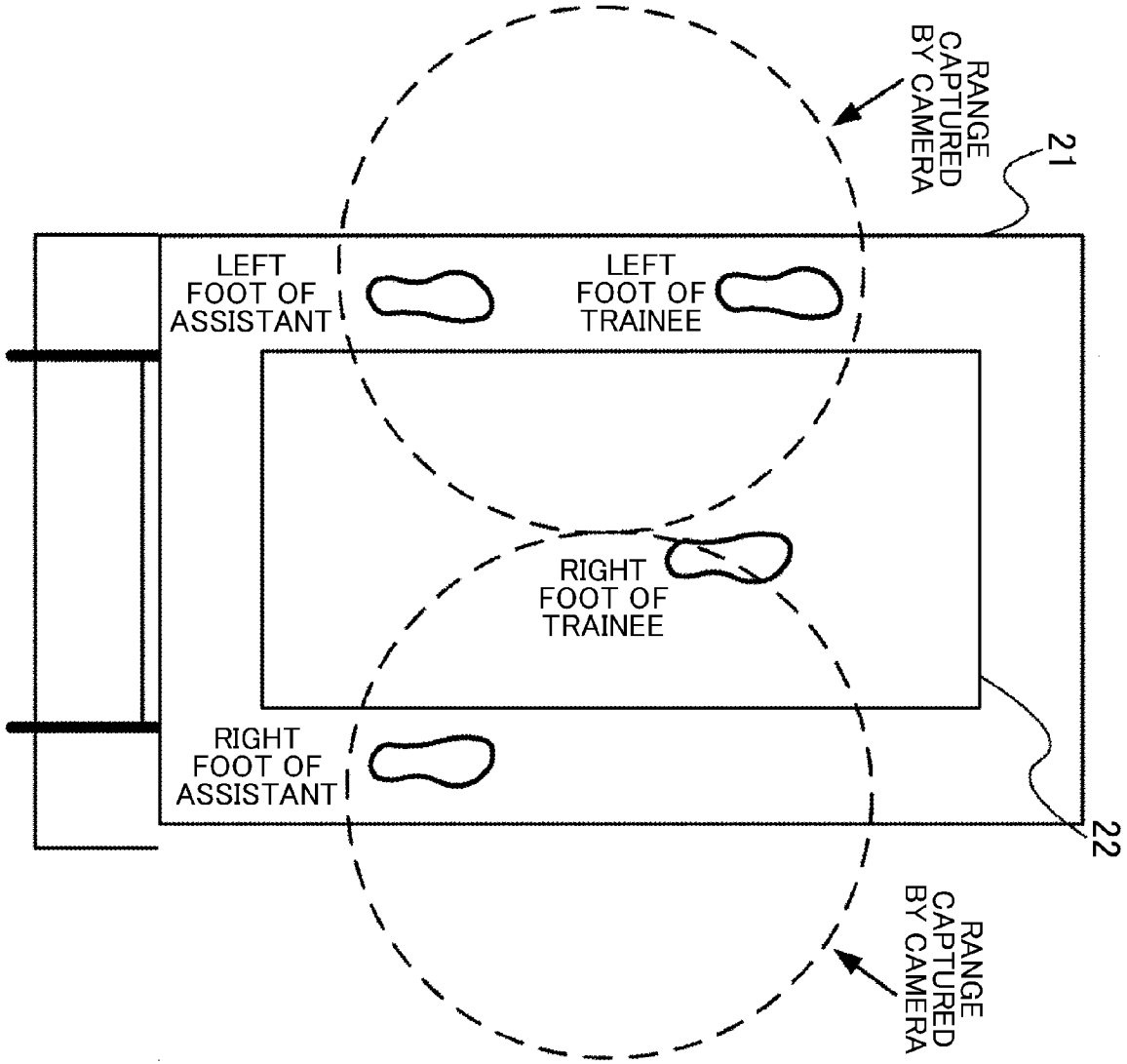
FIG. 18 is a top view showing a frame and a conveyor in the fifth embodiment.

Next, the abnormality detection method of the walking training system 1 in the fifth embodiment is described with reference to FIG. 18. FIG. 18 is a top view showing the frame 21 and the conveyor 22.

As described above, the treadmill 2 has two cameras 207 to observe each of the right frame part and the left frame part of the frame 21. Therefore, each of the right frame part and left frame part of the frame 21 is included in each observation range of the two cameras 207.

The two cameras 207 capture the right frame part and the left frame part of the frame 21 respectively. The control device 3 recognizes a foot on the frame 21 based on the result captured by the two cameras 207. To recognize a foot, any technology of the general image recognition technologies, such as pattern matching, may be used.

If three or more feet are not recognized based on the result captured by the camera 207, the control device 3 determines that there are not three or more feet on the frame 21. In this case, the control device 3 determines that the state is normal. On the other hand, if three or more feet are recognized based on the result captured by the camera 207, the control device 3 determines that there are three or more feet on the frame 21. In this case, the control device 3 determines that the state is abnormal.

Figure 19:
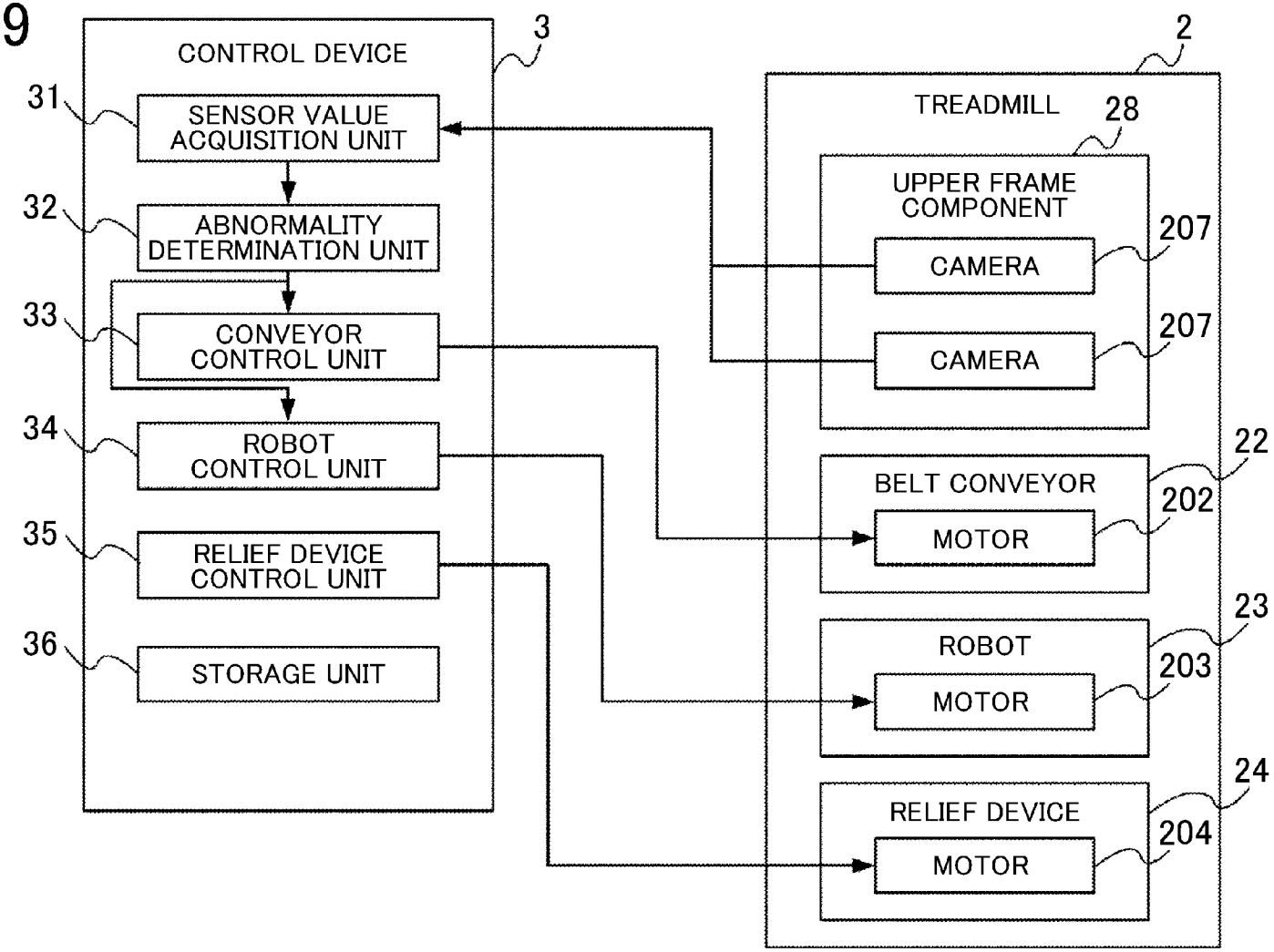
FIG. 19 is a diagram showing a configuration of the control system of the walking training system in the fifth embodiment.

Next, the configuration of the control system of the walking training system 1 in the fifth embodiment is described below with reference to FIG. 19. As shown in FIG. 19, the fifth embodiment is different from the first embodiment in that, in the treadmill 2, the frame 21 has not a plurality of load sensors 201 but the upper frame component 28 has two cameras 207.

Each of the two cameras 207 sends the image information, which indicates the image of the frame 21 generated by the capturing, to the control device 3. In the fifth embodiment, the sensor value acquisition unit 31 receives the image information sent from the two cameras 207 instead of the load distribution information sent from the plurality of load sensors 201.

In the fifth embodiment, the abnormality determination unit 32 analyzes the image, which indicates the image information received by the sensor value acquisition unit 31, to determine whether there are three or more feet on the frame 21. That is, the abnormality determination unit 32 determines whether three or more feet are recognized. If three or more feet are not recognized, the abnormality determination unit 32 determines that the state is normal. On the other hand, if three or more feet are recognized, the abnormality determination unit 32 determines that the state is abnormal.

As described above, in the fifth embodiment, at least one camera 207 is provided for capturing the frame 21. If a foot is recognized by analyzing the image generated by the capturing by the camera 207, the abnormality determination unit 32 determines that there is a foot on the frame 21. In this way, an abnormal state during walking training can be detected also by a sensor (image sensor) other than the load sensors 201.

Figure 20:
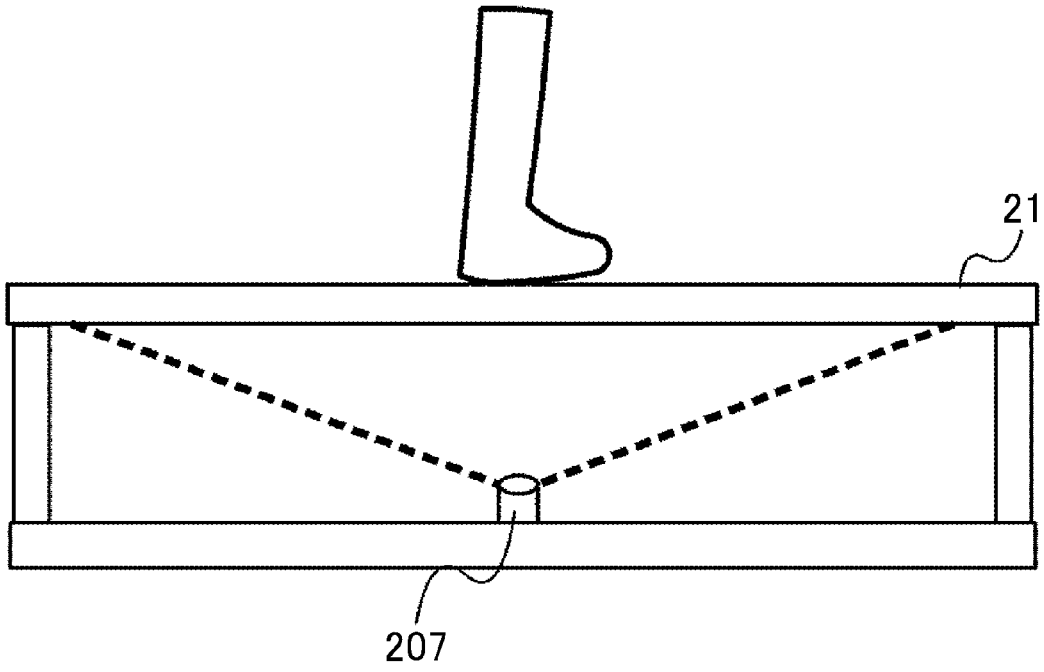
FIG. 20 is a diagram showing another observation method in the fifth embodiment.

The method for recognizing a foot by means of the camera 207 is not limited to the example described above. For example, as shown in FIG. 20, with a transparent or semi-transparent material used as the material of the frame 21, the camera 207 may be arranged so that the bottom face of the frame 21 is captured. That is, the camera 207 is arranged in such a way that the camera 207, provided below the frame 21, captures the image above.

The present invention is not limited to the embodiments described above but may be changed as necessary without departing from the spirit.

What is claimed is:

1. A walking training system comprising:

a belt conveyor that is configured so that a trainee walks on the belt conveyor;

a pair of frames that are positioned on both sides of the belt conveyor, one frame being positioned on each side of the belt conveyor to allow an assistant to place a foot on each frame;

a sensor that is configured to detect the presence of a foot on each frame; and a control device that is configured to:

determine whether there are three or more feet on the pair of frames based on a measurement result of the sensor, and perform abnormal-time control if the control device determines that there are three or more feet on the pair of frames.

2. The walking training system according to claim 1, wherein:

the sensor is configured to measure a load on the pair of frames from foot, and the control device is configured to determine that there is a foot on the pair of frames when the sensor measures the load.

3. The walking training system according to claim 2, wherein:

the sensor is configured to measure a load distribution on the pair of frames from the foot, and the control device is configured to:

determine that there are two feet on one of the frames when a length between two load distributions on the one frame is longer than a predetermined length, and determine that there is one foot on the one of the frames when the length between two load distributions on the one of the frames is equal to or shorter than the predetermined length.

4. The walking training system according to claim 3, wherein:

the sensor includes a plurality of load sensors, each of which measures the load distribution on the pair of frames from the foot, and the plurality of load sensors are arranged close together on the pair of frames within a predetermined range on a side in a direction opposite to a direction of movement of the trainee.

5. The walking training system according to claim 4, wherein:

the sensor includes an ON/OFF sensor, the ON/OFF sensor being turned on when a foot is placed on one of the frames, and being turned off when a foot is not placed on one of the frames, the ON/OFF sensor being positioned outside a range in which the plurality of load sensors are arranged on the pair of frames, and the control device is configured to determine that there are three or more feet on the pair of frames when the control device determines that there are two feet on the pair of frames based on a measurement result of the plurality of load sensors and when the ON/OFF sensor is turned on.

6. The walking training system according to claim 1, wherein:

the sensor includes a plurality of photo-electronic sensors, the photo-electronic sensors being configured to observe a boundary between the belt conveyor and the pair of frames, and the control device is configured to determine that there is a foot on one of the frames if a blocking of light is detected by the photo-electronic sensors.

7. The walking training system according to claim 6, wherein:

the control device is configured to:

determine that there are two feet on the belt conveyor when a length of a blocked light is longer than a predetermined length, and determine that there is one foot on the belt conveyor when the length of the blocked light is equal to or shorter than the predetermined length.

8. The walking training system according to claim 1, wherein:

the sensor includes at least one camera that captures the pair of frames, and the control device is configured to determine that there is a foot on the pair of frames when the control device recognizes the foot by analyzing an image generated by the capturing by the camera.

9. The walking training system according to claim 1, wherein:

during the abnormal-time control, the control device decelerates the belt conveyor or stops the belt conveyor.

10. A walking training system comprising:

a belt conveyor that is configured so that a trainee walks on the belt conveyor;

a pair of frames that are positioned on both sides of the belt conveyor, one frame being positioned on each side of the belt conveyor to allow an assistant to place a foot on each frame;

a sensor that is configured to detect the presence of a foot on the belt conveyor; and a control device that is configured to:

determine whether there are three or more feet on the belt conveyor based on a measurement result of the sensor, and perform abnormal-time control if the control device determines that there are three or more on the belt conveyor.

* * * * *